US010625512B2

(12) United States Patent
Ishida et al.

(10) Patent No.: US 10,625,512 B2
(45) Date of Patent: Apr. 21, 2020

(54) LIQUID DISCHARGE APPARATUS AND CONTROL METHOD OF LIQUID DISCHARGE APPARATUS

(71) Applicant: SEIKO EPSON CORPORATION, Tokyo (JP)

(72) Inventors: Yukimasa Ishida, Shiojiri (JP); Hironori Matsuoka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/024,457

(22) Filed: Jun. 29, 2018

(65) Prior Publication Data

US 2019/0001689 A1 Jan. 3, 2019

(30) Foreign Application Priority Data

Jun. 30, 2017 (JP) ..... 2017-128206

(51) Int. Cl.

| | |
|---|---|
| ***B41J 2/175*** | (2006.01) |
| ***B41J 2/045*** | (2006.01) |
| ***B41J 2/14*** | (2006.01) |
| ***B41J 2/195*** | (2006.01) |

(52) U.S. Cl.

CPC ..... *B41J 2/17556* (2013.01); *B41J 2/0451* (2013.01); *B41J 2/04578* (2013.01); *B41J 2/04581* (2013.01); *B41J 2/1433* (2013.01); *B41J 2/14233* (2013.01); *B41J 2/175* (2013.01); *B41J 2/17523* (2013.01); *B41J 2/17596* (2013.01); *B41J 2/195* (2013.01); *B41J 2002/14419* (2013.01)

(58) Field of Classification Search

CPC ..... B41J 2/04581; B41J 2/04588; B41J 2/04541; B41J 29/38

USPC ..... 347/9, 68–72

See application file for complete search history.

(56) References Cited

U.S. PATENT DOCUMENTS

| | | | | |
|---|---|---|---|---|
| 9,457,563 | B2 * | 10/2016 | Nakazawa | B41J 2/04541 |
| 10,239,318 | B2 * | 3/2019 | Takaai | B41J 2/16517 |
| 2003/0146958 | A1 | 8/2003 | Aruga et al. | |
| 2004/0223027 | A1 | 11/2004 | Shinkawa et al. | |
| 2016/0023464 | A1 | 1/2016 | Nakao et al. | |

FOREIGN PATENT DOCUMENTS

| | | | |
|---|---|---|---|
| JP | 2003-127418 | A | 5/2003 |
| JP | 2004-142405 | A | 5/2004 |
| JP | 2004-276544 | A | 10/2004 |
| JP | 4155324 | B | 7/2008 |
| JP | 5321154 | B | 7/2013 |
| JP | 2013-184336 | A | 9/2013 |
| JP | 2016-22704 | A | 2/2016 |
| JP | 2016-168818 | A | 9/2016 |
| JP | 2017-007246 | A | 1/2017 |

* cited by examiner

*Primary Examiner* — An H Do

(74) *Attorney, Agent, or Firm* — Workman Nydegger

(57) ABSTRACT

A liquid discharge apparatus including a liquid discharge head that discharges a liquid by vibrating a vibration plate by a drive element and changing a pressure in an internal space filled with the liquid, a pressurization supply unit that forcibly feeds the liquid into the liquid discharge head, and a controller that restricts drive of the drive element in accordance with a pressure condition in the liquid discharge head.

19 Claims, 12 Drawing Sheets

LIQUID DISCHARGE APPARATUS AND CONTROL METHOD OF LIQUID DISCHARGE APPARATUS

CROSS-REFERENCE TO RELATED APPLICATIONS

This application claims priority to Japanese Patent Application No. 2017-128206 filed on Jun. 30, 2017. The entire disclosures of Japanese Patent Application No. 2017-128206 are hereby incorporated herein by reference.

BACKGROUND

1. Technical Field

The present invention relates to a technique for discharging liquid such as ink.

2. Related Art

In a liquid discharge apparatus, a liquid such as ink is forcibly fed from a liquid container to a liquid discharge head. For example, in a liquid discharge head of JP-A-2013-184336, a forcibly fed liquid is supplied to a pressure chamber through a flow path. The liquid in the pressure chamber is discharged from a nozzle by vibrating a vibration plate that is a part of a wall surface of the pressure chamber by a drive element and changing a pressure in the pressure chamber.

However, in a liquid discharge apparatus that forcibly feeds a liquid of a liquid container and supplies the liquid to a liquid discharge head as in JP-A-2013-184336, an excessive pressure may be applied in the liquid discharge head due to a failure or the like of the valve apparatus. For example, in a valve apparatus (for example, a self-sealing valve) provided in a flow path through which a liquid is supplied to the liquid discharge head, there is a risk that liquid leakage occurs due to a phenomenon where components contained in the liquid adhere to a valve body and a valve seat and deposit grows and thereby a closing failure of the valve apparatus occurs. When the liquid leakage occurs in the valve apparatus, a pressure of the forcibly fed liquid is transferred into the liquid discharge head and an excessive pressure is applied to a pressure chamber and the like in the liquid discharge head. In a state where an excessive pressure is applied in the liquid discharge head in this way, when a drive element is driven and a vibration plate is vibrated, there is a risk that a crack occurs in the vibration plate and the vibration plate is damaged.

SUMMARY

An advantage of some aspects of the invention is to suppress generation of a crack in the vibration plate.

Aspect 1

A liquid discharge apparatus according to a preferred aspect (aspect 1) of the invention includes a liquid discharge head that discharges a liquid by vibrating a vibration plate by a drive element and changing a pressure in an internal space filled with the liquid, a pressurization supply unit that forcibly feeds the liquid into the liquid discharge head, and a controller that restricts drive of the drive element in accordance with a pressure condition in the liquid discharge head. According to the above aspect, the drive of the drive element is restricted in accordance with the pressure condition in the liquid discharge head. Therefore, in an abnormal pressure condition such as, for example, when liquid leakage or the like occurs due a closing failure of a valve apparatus and an excessive pressure is applied in the liquid discharge head, it is possible to restrict the drive of the drive element. Thus, it is possible to suppress vibration of the vibration plate in a state in which an excessive pressure is applied in the liquid discharge head, so that generation of a crack in the vibration plate can be suppressed.

Aspect 2

A liquid discharge apparatus according to a preferred aspect (aspect 2) of the invention includes a liquid discharge head that discharges a liquid by vibrating a vibration plate by a drive element and changing a pressure in an internal space filled with the liquid, a pressurization supply unit that forcibly feeds the liquid into the liquid discharge head, and a controller that performs control to reduce a pressure of the liquid in accordance with a pressure condition in the liquid discharge head. According to the above aspect, the pressure of the liquid is reduced in accordance with the pressure condition in the liquid discharge head. Therefore, in an abnormal pressure condition such as, for example, when liquid leakage or the like occurs due a closing failure of a valve apparatus and an excessive pressure is applied in the liquid discharge head, the pressure can be reduced. Thus, it is possible to suppress vibration of the vibration plate in a state in which an excessive pressure is applied in the liquid discharge head, so that generation of a crack in the vibration plate can be suppressed.

Aspect 3

A liquid discharge apparatus according to a preferred aspect (aspect 3) of the invention includes a liquid discharge head that discharges a liquid by vibrating a vibration plate by a drive element and changing a pressure in an internal space filled with the liquid, a pressurization supply unit that forcibly feeds the liquid into the liquid discharge head, a receiving unit that receives print data, and a controller that performs control to reduce a pressure of the liquid by receiving the print data. According to the above aspect, the pressure of the liquid is reduced by receiving the print data, so that a pressure in the liquid discharge head can be reduced before the drive element is driven by the print data. In this way, the pressure in the liquid discharge head can be reduced in advance, so that even when liquid leakage occurs due a closing failure or the like of a valve apparatus, an excessive pressure in the liquid discharge head can be reduced when the vibration plate is vibrated. Therefore, generation of a crack in the vibration plate can be suppressed.

Aspect 4

A liquid discharge apparatus according to a preferred aspect (aspect 4) of the invention includes a liquid discharge head that discharges a liquid by vibrating a vibration plate by a drive element and changing a pressure in an internal space filled with the liquid, a pressurization supply unit that forcibly feeds the liquid into the liquid discharge head, a receiving unit that receives print data, and a controller that controls a supply pressure of the liquid in accordance with content of the received print data. According to the above aspect, the supply pressure of the liquid is controlled in accordance with the content of the received print data, so that even when ink leakage occurs due to a closing failure or the like of a valve apparatus, it is possible to drive the drive element while suppressing crack of the vibration plate.

In a preferred example of the aspects 1 to 4, a valve apparatus that opens/closes according to pressure in the liquid discharge head is included in a flow path between the pressurization supply unit and the liquid discharge head, the liquid is supplied to the liquid discharge head when the valve apparatus opens, and the controller may perform control of either of (A) or (B) when liquid leakage occurs in the valve apparatus. According to the above aspect, for example, the liquid can be supplied even when the liquid is consumed by the liquid discharge head, and in an abnormal pressure condition such as when leakage (closing failure) occurs in the valve apparatus and an excessive pressure is applied in the liquid discharge head, the pressure can be reduced.

In this case, as a restriction of the drive of the drive element, an input of a drive waveform into the drive element that discharges liquid when the drive waveform is inputted may be restricted, or a discharge amount by the drive element may be reduced.

Further, the pressurization supply unit includes a pump, a gas chamber, a liquid chamber, and a flexible film that separates the gas chamber and the liquid chamber from each other, and when forcibly feeding a liquid of the liquid chamber to the liquid discharge head by pressurizing or depressurizing the gas chamber by the pump, the controller may reduce the pressure of the liquid by controlling an atmospheric air opening valve that opens the gas chamber to atmosphere.

Alternatively, the controller may reduce the pressure of the liquid by controlling a waste liquid valve provided in a flow path between the pressurization supply unit and the liquid discharge head.

Further, these controls by the controller may be performed after the print data is received.

Aspect 5

In a preferred example (aspect 5) of the aspects 1 and 2, the pressure condition in the liquid discharge head is detected from a residual vibration due to drive of the drive element. According to the above aspect, the pressure condition in the liquid discharge head is detected from a residual vibration due to drive of the drive element, so that it is not necessary to separately provide a pressure sensor or the like.

Aspect 6

In a preferred example (aspect 6) of the aspects 1 and 2, the pressure condition in the liquid discharge head is detected from a displacement of a flexible film constituting a part of a wall surface of a flow path of the liquid. According to the above aspect, the pressure condition in the liquid discharge head is detected from the displacement of a flexible film constituting a part of a wall surface of a flow path of the liquid, so that it is not necessary to separately provide a pressure sensor or the like.

Aspect 7

In a preferred example (aspect 7) of the aspect 6, the flexible film is a film for reducing a pressure change of the flow path of the liquid. According to the above configuration, the flexible film is a film for reducing a pressure change of the flow path of the liquid, so that, for example, it is possible to reduce a pressure change in a flow path which occurs when driving the drive element at high frequency. Therefore, the drive element can be driven at high speed and a stable high-speed printing can be performed.

Aspect 8

In a preferred example (aspect 8) of the aspect 6, the flexible film is a film for generating a pressure change in the flow path of the liquid. According to the above configuration, the flexible film is a film for generating a pressure change in the flow path of the liquid, so that, for example, it is possible to perform cleaning of a discharge surface where nozzles are formed while exuding ink from the nozzles by generating pressure change in the flow path.

Aspect 9

In a preferred example (aspect 9) of any one of the aspects 1 to 8, a valve apparatus that opens/closes a flow path is included in a middle of the flow path of the liquid and the valve apparatus has a valve body that opens/closes a first flow path communicating with the pressurization supply unit and a second flow path communicating with the liquid discharge head and a flexible film that moves the valve body. According to the above aspect, a valve apparatus that opens/closes a flow path is included in a middle of the flow path of the liquid, so that if the flexible film is displaced by a differential pressure between both sides of the flexible film along with consumption of the liquid by the liquid discharge head and thereby moves the valve body, it is possible to adjust the pressure in the liquid discharge head.

Aspect 10

In a preferred example (aspect 10) of the aspect 9, the pressure condition in the liquid discharge head is detected from a displacement of the flexible film of the valve apparatus. According to the above aspect, the pressure condition in the liquid discharge head is detected from a displacement of the flexible film of the valve apparatus. For example, when adhering materials or the like are adhered to the valve body of the valve apparatus and leakage occurs, the displacement of the flexible film is different from that when no leakage occurs. Therefore, the pressure condition in the liquid discharge head can be detected by detecting the displacement of the flexible film.

Aspect 11

In a preferred example (aspect 11) of any one of the aspects 1 to 10, a control valve that opens/closes according to pressure in the liquid discharge head is included, and when the control valve opens, the pressure in the liquid discharge head decreases. According to the above aspect, when the control valve opens, the pressure in the liquid discharge head decreases, so that even in an abnormal pressure condition such as when an excessive pressure is applied in the liquid discharge head due to, for example, a failure of the valve apparatus, the excessive pressure can be reduced by releasing the pressure from the control valve.

Aspect 12

In a preferred example (aspect 12) of the aspects 3 and 4, the controller performs control to restrict drive of the drive element or reduce a pressure of the liquid in accordance with the pressure condition in the liquid discharge head. According to the above aspect, it is possible to restrict the drive of the drive element and reduce the pressure of the liquid in accordance with not only reception of the print data and content of the print data but also the pressure condition in the liquid discharge head. Therefore, it is possible to suppress vibration of the vibration plate in a pressure condition in which an excessive pressure is applied in the liquid discharge head, and it is also possible to reduce an excessive pressure in the liquid discharge head when vibrating the vibration plate, so that it is possible to suppress generation of a crack in the vibration plate.

Aspect 13

A method according to a preferred aspect (aspect 13) of the invention is a control method of a liquid discharge apparatus. The liquid discharge apparatus includes a liquid discharge head that discharges a liquid by vibrating a vibration plate by a drive element and changing a pressure in an internal space filled with the liquid, and a pressurization supply unit that forcibly feeds the liquid into the liquid discharge head, and the control method controls drive of the drive element in accordance with a change of a pressure condition in the liquid discharge head. According to the above aspect, the drive of the drive element is restricted in accordance with the pressure condition in the liquid discharge head. Therefore, in an abnormal pressure condition such as, for example, when liquid leakage or the like occurs due a closing failure of a valve apparatus and an excessive pressure is applied in the liquid discharge head, it is possible to restrict the drive of the drive element. Thus, it is possible to suppress vibration of the vibration plate in a state in which an excessive pressure is applied in the liquid discharge head, so that generation of a crack in the vibration plate can be suppressed.

Aspect 14

A method according to a preferred aspect (aspect 14) of the invention is a control method of a liquid discharge apparatus. The liquid discharge apparatus includes a liquid discharge head that discharges a liquid by vibrating a vibration plate by a drive element and changing a pressure in an internal space filled with the liquid, and a pressurization supply unit that forcibly feeds the liquid into the liquid discharge head, and the control method performs control to reduce a pressure of the liquid in accordance with a pressure condition in the liquid discharge head. According to the above aspect, the pressure of the liquid is reduced in accordance with the pressure condition in the liquid discharge head. Therefore, in an abnormal pressure condition such as, for example, when liquid leakage or the like occurs due a closing failure of a valve apparatus and an excessive pressure is applied in the liquid discharge head, the pressure can be reduced. Thus, it is possible to suppress vibration of the vibration plate in a state in which an excessive pressure is applied in the liquid discharge head, so that generation of a crack in the vibration plate can be suppressed.

Aspect 15

A method according to a preferred aspect (aspect 15) of the invention is a control method of a liquid discharge apparatus. The liquid discharge apparatus includes a liquid discharge head that discharges a liquid by vibrating a vibration plate by a drive element and changing a pressure in an internal space filled with the liquid, a pressurization supply unit that forcibly feeds the liquid into the liquid discharge head, and a receiving unit that receives print data, and the control method performs control to reduce a pressure of the liquid by receiving the print data. According to the above aspect, the pressure of the liquid is reduced by receiving the print data, so that a pressure in the liquid discharge head can be reduced before the drive element is driven by the print data. In this way, the pressure in the liquid discharge head can be reduced in advance, so that even when liquid leakage occurs due a closing failure or the like of a valve apparatus, an excessive pressure in the liquid discharge head can be reduced when the vibration plate is vibrated. Therefore, generation of a crack in the vibration plate can be suppressed.

Aspect 16

A method according to a preferred aspect (aspect 16) of the invention is a control method of a liquid discharge apparatus. The liquid discharge apparatus includes a liquid discharge head that discharges a liquid by vibrating a vibration plate by a drive element and changing a pressure in an internal space filled with the liquid, a pressurization supply unit that forcibly feeds the liquid into the liquid discharge head, and a receiving unit that receives print data, and the control method controls a supply pressure of the liquid in accordance with content of the received print data. According to the above aspect, the supply pressure of the liquid is controlled in accordance with the content of the received print data, so that it is not necessary to increase the supply pressure of the liquid in preparation for printing whose discharge amount is large. Therefore, it is possible to reduce the pressure in the liquid discharge head. Thus, it is possible to reduce an excessive pressure in the liquid discharge head when vibrating the vibration plate, so that it is possible to suppress generation of a crack in the vibration plate.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
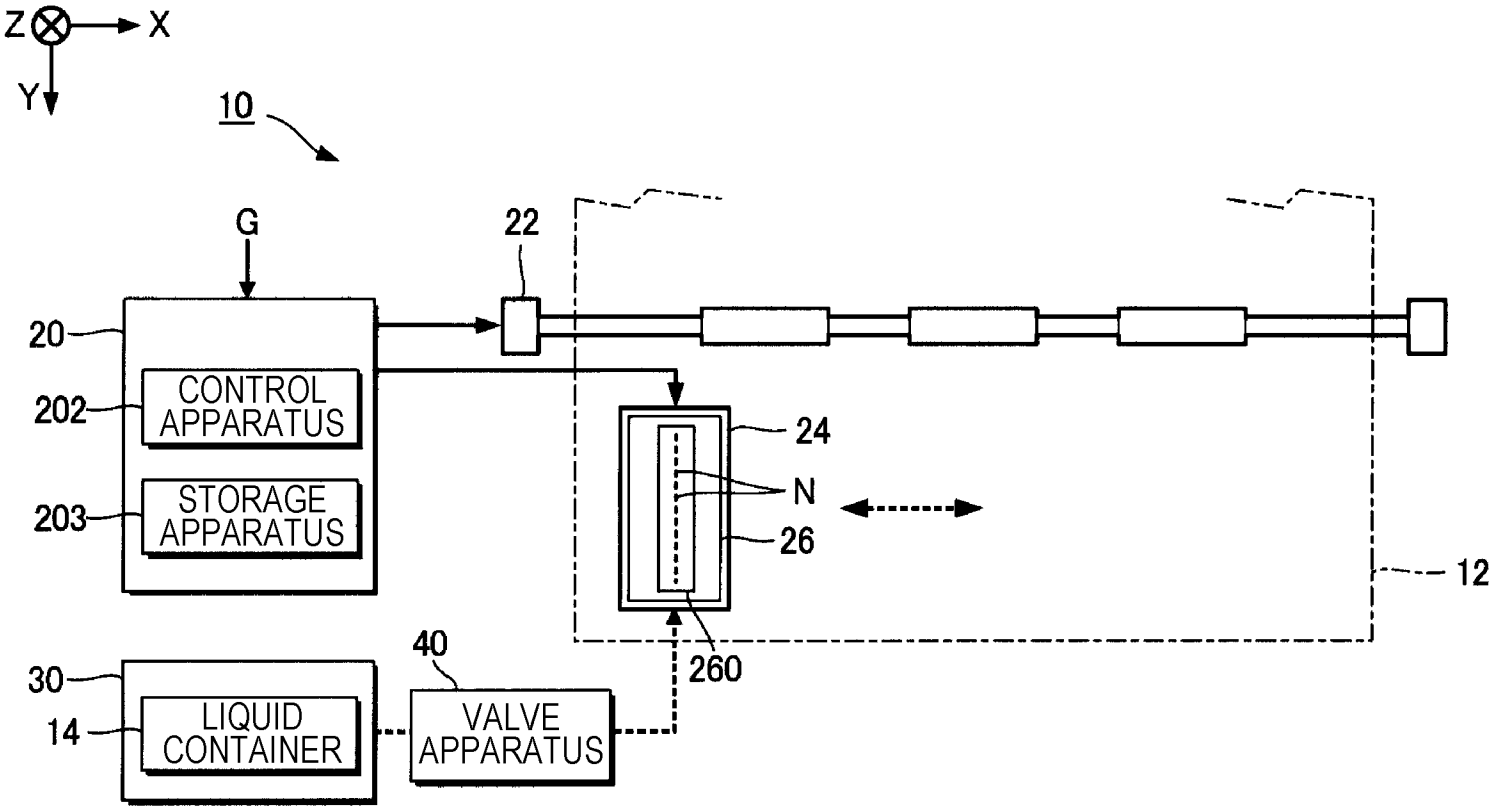
FIG. 1 is a configuration diagram of a liquid discharge apparatus according to a first embodiment.

FIG. 1 is a partial configuration diagram of a liquid discharge apparatus 10 according to a first embodiment of the invention. The liquid discharge apparatus 10 of the present embodiment is an ink jet system printing apparatus that discharges ink, which is an example of liquid, to a medium 12 such as a printing paper sheet. The liquid discharge apparatus 10 shown in FIG. 1 includes a control unit 20, a transport mechanism 22, a carriage 24, and a liquid discharge head 26. Although FIG. 1 illustrates a case where one liquid discharge head 26 is mounted on the carriage 24, a plurality of liquid discharge heads 26 may be mounted on the carriage 24. The liquid discharge apparatus 10 is attached with a liquid container (cartridge) 14 that reserves ink.

The liquid container 14 is an ink tank composed of a box-shaped container that is attachable to and detachable from a main body of the liquid discharge apparatus 10. The liquid container 14 is not limited to a box-shaped container but may be an ink pack composed of a bag-shaped container. Ink is reserved in the liquid container 14. The ink may be black ink or may be color ink. The liquid container 14 is provided in a pressurization supply unit 30. The pressurization supply unit 30 pressurizes the ink in the liquid container 14 and supplies (forcibly feeds) the ink to the liquid discharge head 26.

The control unit 20 includes, for example, a control apparatus 202 such as a CPU (Central Processing Unit) or an FPGA (Field Programmable Gate Array) and a storage apparatus 203 such as a semiconductor memory. The control apparatus 202 executes a control program stored in the storage apparatus 203, so that the control unit 20 integrally controls each element of the liquid discharge apparatus 10. As shown in FIG. 1, print data G that represents an image to be formed on the medium 12 is supplied from an external apparatus (not shown in the drawings) such as a host computer to the control unit 20. The control unit 20 controls each element of the liquid discharge apparatus 10 so that the image specified by the print data G is formed on the medium 12.

The transport mechanism 22 transports the medium 12 in a Y direction under control of the control unit 20. The liquid discharge head 26 is mounted on the carriage 24 having a substantially box shape and discharges ink supplied from the liquid container 14 to the medium 12 under control of the control unit 20. The control unit 20 reciprocates the carriage 24 along an X direction crossing the Y direction. The liquid discharge head 26 discharges ink to the medium 12 in parallel with the transport of the medium 12 by the transport mechanism 22 and repetitive reciprocation of the carriage 24, so that a desired image is formed on a surface of the medium 12. The liquid container 14 can be mounted on the carriage 24 along with the liquid discharge head 26.

A nozzle array is arranged on a discharge surface 260 (a surface facing the medium 12) of the liquid discharge head 26. The nozzle array is a set of a plurality of nozzles N that are arranged lineally along the Y direction. The nozzle N discharges ink supplied from the liquid container 14. The number and the arrangement of the nozzles are not limited to those illustrated here, but two or more nozzle arrays may be arranged on a discharge surface 260 of the liquid discharge head 26 or a plurality of nozzle arrays can be arranged in a zigzag pattern or a staggered pattern. A direction perpendicular to an X-Y plane (a plane in parallel with the surface of the medium 12) is written as a Z direction.

A flow path communicating with the liquid discharge head 26 is provided with a valve apparatus 40. The valve apparatus 40 of the present embodiment is arranged in the middle of the flow path communicating between the liquid container 14 and the liquid discharge head 26. Although the valve apparatus 40 of the present embodiment is illustrated as a component different from the liquid discharge head 26, the valve apparatus 40 may be mounted on the carriage 24 along with the liquid discharge head 26 as a component of the liquid discharge head 26. The valve apparatus 40 is a structure in which a flow path that supplies ink, which is supplied from the liquid container 14, to the liquid discharge head 26 is formed. The valve apparatus 40 of the present embodiment functions as a self-sealing valve that adjusts pressure of ink by opening/closing (releasing/blocking) the flow path by a valve body (switching member) 82 described later.

Figure 2:
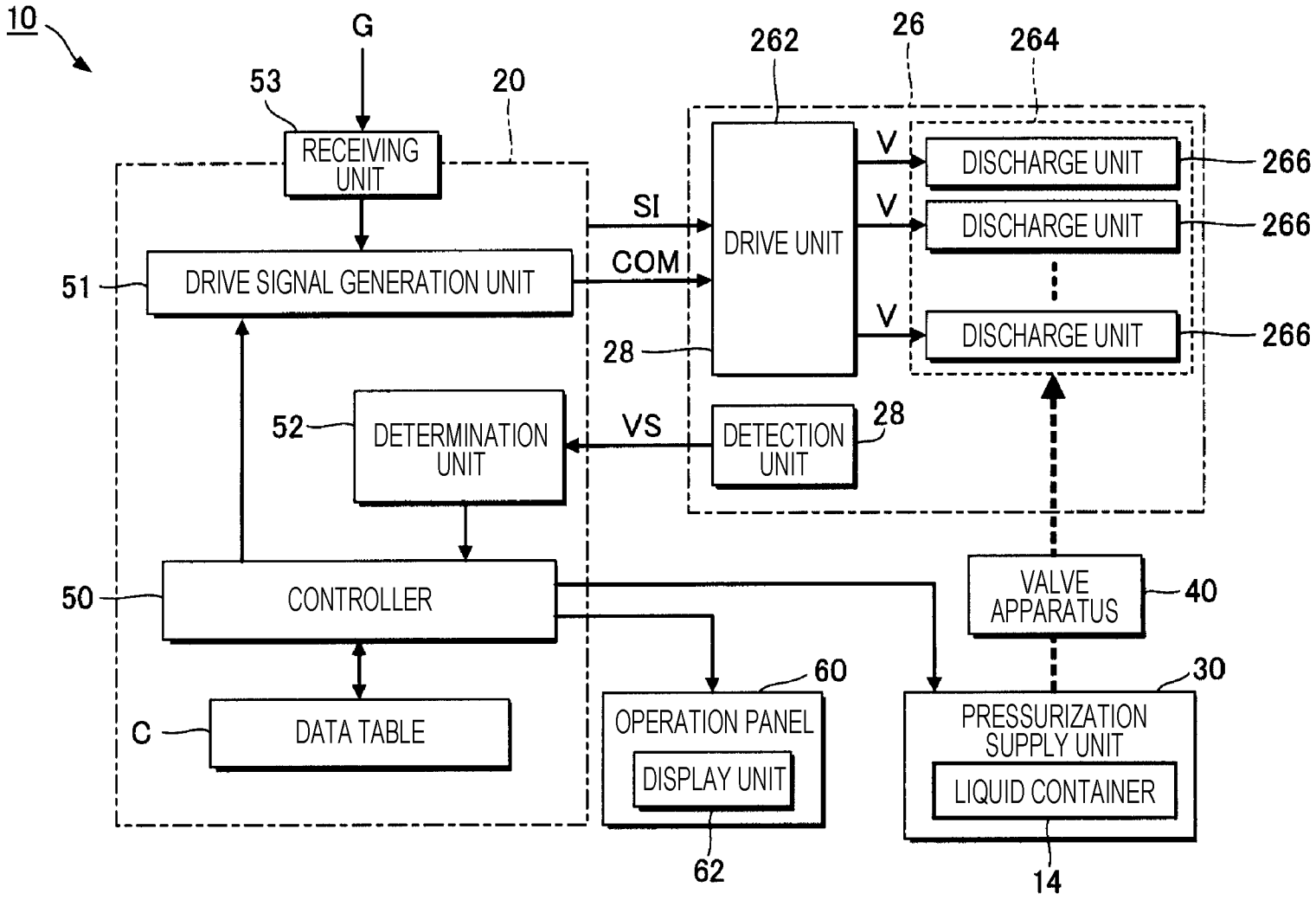
FIG. 2 is a functional configuration diagram of the liquid discharge apparatus.

FIG. 2 is a functional configuration diagram of the liquid discharge apparatus 10. In FIG. 2, the transport mechanism 22 and the carriage 24 are omitted for convenience. The control apparatus 202 executes the control program, so that the control apparatus 202 functions as a controller 50, a drive signal generation unit 51, a determination unit 52, and a receiving unit 53. The controller 50, the drive signal generation unit 51, the determination unit 52, and the receiving unit 53 may be configured by electronic circuits. The controller 50 may be a processor. The receiving unit 53 receives the print data G. The controller 50 controls the drive signal generation unit 51. A data table C is stored in the storage apparatus 203. The data table C may be stored in a memory included in the storage apparatus 203. The drive signal generation unit 51 generates a drive signal COM. The drive signal COM is, for example, a drive waveform W as shown in FIG. 3, that is a waveform of a voltage signal including a plurality of potentials (maximum potential VH, minimum potential VL, and the like) having potential differences with respect to a reference potential VM.

During a cycle T, the drive waveform W transits from the reference potential VM to the potential VL and the potential VL is maintained for a certain period of time and thereafter the drive waveform W transits from the potential VL, which is the minimum value of the potential, to the potential VH, which is the maximum value of the potential, and the potential VH is maintained for a certain period of time. Thereafter, the drive waveform W transits from the potential VH to the reference potential VM. According to such a drive waveform W, when the drive waveform W transits from the reference potential VM to the potential VL, a meniscus in the nozzle N is once drawn to a pressure chamber SC. Thereafter, when the drive waveform W transits from the potential VL to the potential VH, the meniscus in the nozzle N moves at once toward an opening portion of the nozzle N (an opening portion of the nozzle N from which ink is discharged) and ink is pushed out from the opening portion of the nozzle N. When the drive waveform W transits from the potential VH to the reference potential VM, the meniscus in the nozzle N is drawing to the pressure chamber SC, so that the ink pushed out from the opening portion of the nozzle N can be torn off, and a droplet of the ink is discharged from the opening portion of the nozzle N.

Figure 3:
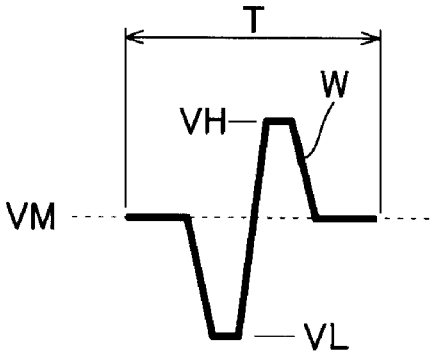
FIG. 3 is a diagram showing a specific example of a drive waveform.

The shape of the drive waveform W is not limited to that shown in FIG. 3. A discharged weight of ink discharged from the nozzle N can be changed by changing the shape of the drive waveform W (VH, VL, amplitude, gradient, and the like). The number of drive waveforms W included in one cycle T of the drive signal COM is not limited to one, but a plurality of drive waveforms W may be included in one cycle T. Further, the number of types of the drive signal COM is not limited to one, but there may be a plurality of drive signals COM whose drive waveforms W are different from each other. Data for generating the drive signal COM (for example, potential data) is stored in the data table C. When generating each drive signal COM, the controller 50 reads data corresponding to the drive waveform W of the drive signal COM from the data table C and causes the drive signal generation unit 51 to generate the drive signal COM.

As shown in FIG. 2, the liquid discharge head 26 includes a drive unit 262 and a liquid discharge unit 264. The drive unit 262 drives the liquid discharge unit 264 under control of the control unit 20. The liquid discharge unit 264 discharges ink supplied from the liquid container 14 to the medium 12 from a plurality of nozzles N. The liquid discharge unit 264 includes a plurality of discharge units 266 corresponding to the plurality of nozzles N. Each discharge unit 266 discharges ink according to a drive signal V supplied from the drive unit 262.

The drive signal COM generated by the drive signal generation unit 51 and a print signal SI that specifies the presence or absence of ink discharge for each nozzle N according to the print data G are supplied from the control unit 20 to the drive unit 262. The drive unit 262 generates a drive signal V according to the drive signal COM and the print signal SI for each discharge unit 266 and outputs the drive signals V in parallel to the plurality of discharge units 266. Specifically, the drive unit 262 supplies the drive signal COM as the drive signal V to the discharge units 266, which the print signal SI instructs to discharge ink, of the plurality of discharge units 266, and supplies the reference potential VM as the drive signal V to the discharge units 266, which the print signal SI instructs not to discharge ink, of the plurality of discharge units 266.

Figure 4:
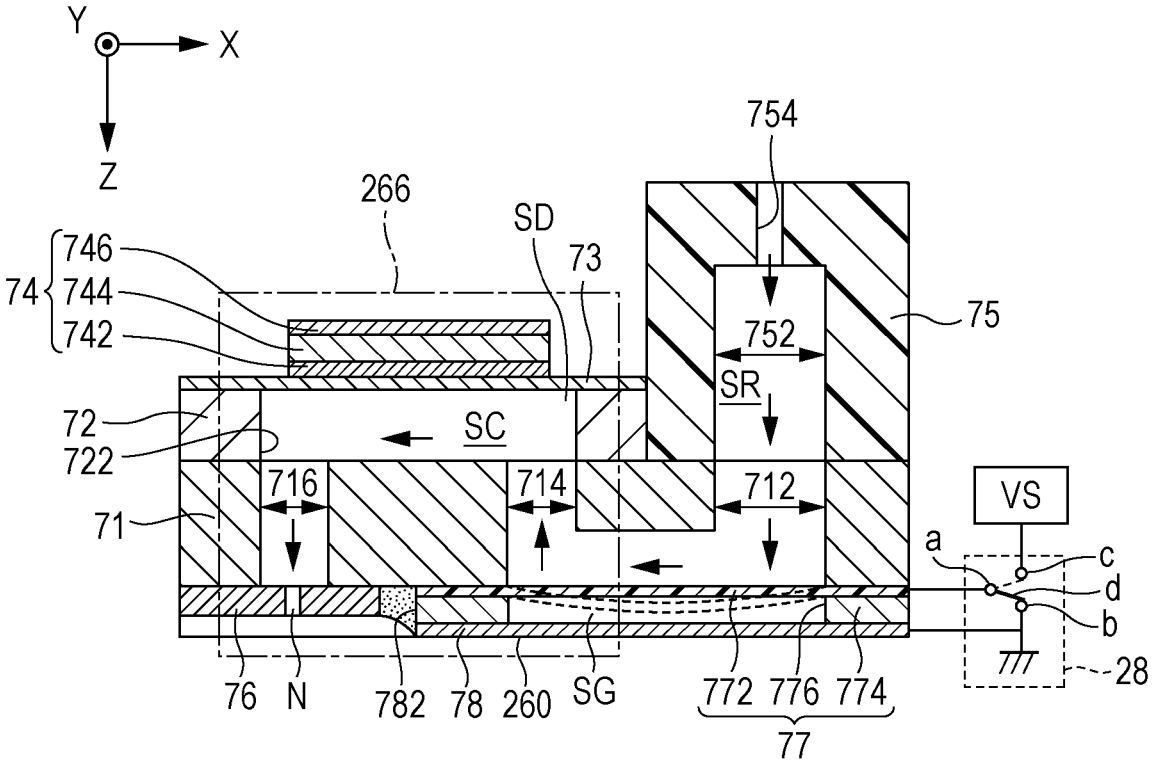
FIG. 4 is a cross-sectional view of a liquid discharge unit.

FIG. 4 is a cross-sectional view of the liquid discharge unit 264 focusing attention on one optional discharge unit 266. The liquid discharge unit 264 shown in FIG. 4 is a structure in which a pressure chamber substrate 72, a vibration plate 73, a piezoelectric element 74, and a support body 75 are arranged on one side (negative side in a Z direction) of a flow path substrate 71 and a nozzle plate 76 and a compliance unit 77 are arranged on the other side (positive side in the Z direction). The flow path substrate 71, the pressure chamber substrate 72, and the nozzle plate 76 are formed of, for example, a silicon flat plate material, and the support body 75 is formed by, for example, injection molding of resin material. The plurality of nozzles N are formed in the nozzle plate 76. In the configuration of FIG. 4, a surface of the nozzle plate 76 facing the medium 12 constitutes the discharge surface 260 of the liquid discharge head.

In the flow path substrate 71, an opening portion 712, a branch flow path 714, and a communication flow path 716 are formed. The branch flow path 714 and the communication flow path 716 are through holes formed for each nozzle N. The opening portion 712 is an opening continuing over a plurality of nozzles N. A space that is formed by communicating a storage portion (recessed portion) 752 formed in the support body 75 with the opening portion 712 of the flow path substrate 71 functions as a common liquid chamber (reservoir) SR that reserves ink supplied from the liquid container 14 through an introduction flow path 754 of the support body 75.

The compliance unit 77 in FIG. 4 is an element for suppressing pressure change (pressure variation) of the ink in the liquid reservoir chamber SR. The compliance unit 77 includes a flexible film (elastic film) 772 and a support plate 774. The flexible film 772 is a flexible member formed in a film shape and constitutes a part of a wall surface (specifically, a bottom surface) of the liquid reservoir chamber SR. The support plate 774 is a flat plate formed of a material of high rigidity such as a stainless steel (SUS) and supports the flexible film 772 on a surface of the flow path substrate 71 so that the opening portion 712 is closed by the flexible film 772. An opening portion 776 is formed in a region of the support plate 774 overlapping the liquid reservoir chamber SR through the flexible film 772. A space inside the opening portion 776 of the support plate 774 communicates with the atmosphere and functions as a damper chamber SG for deforming the flexible film 772 so that the pressure change (pressure variation) in the liquid reservoir chamber SR is absorbed.

The compliance unit 77 is fixed to a fixation plate 78. The fixation plate 78 is formed into a predetermined shape with, for example, a material of high rigidity such as a stainless steel. In the fixation plate 78, a plurality of opening portions 782 corresponding to the plurality of discharge units 266, respectively, are formed. The support plate 774 of the compliance unit 77 is fixed to the fixation plate 78 so that the nozzle plate 76 is exposed from the opening portion 782. A filling material formed of, for example, a resin material is filled in a space inside the opening portion 782 (specifically, a gap between an inner circumferential surface of the opening portion 782 and an outer circumferential surface of the nozzle plate 76). The positive side in the Z direction of the opening portion 776 is closed by the fixation plate 78 (or the support plate 774) and a space which is inside the opening portion 776 and is sandwiched between the flexible film 772 and the fixation plate 78 is the damper chamber SG. Even if a pressure change occurs in the liquid reservoir chamber SR when a pressurized ink is introduced from the pressurization supply unit 30 into the liquid reservoir chamber SR, the flexible film 772 is deformed, so that it is possible to absorb the pressure change.

In the pressure chamber substrate 72, an opening portion 722 is formed for each nozzle N. The vibration plate 73 is an elastically deformable flat plate material installed on a surface of the pressure chamber substrate 72 opposite to the flow path substrate 71. A space which is inside each opening portion 722 of the pressure chamber substrate 72 and is sandwiched between the vibration plate 73 and the flow path substrate 71 functions as a pressure chamber (cavity) SC filled with ink supplied from the liquid reservoir chamber SR through the branch flow path 714. Each pressure chamber SC communicates with the nozzle N through the communication flow path 716 of the flow path substrate 71. A space composed of the pressure chamber SC, the liquid reservoir chamber SR, the branch flow path 714 that communicates these chambers, the communication flow path 716, and the nozzle N constitutes an internal space SD of the liquid discharge head 26.

The piezoelectric element 74 is formed for each nozzle N on a surface of the vibration plate 73 opposite to the pressure chamber substrate 72. Each piezoelectric element 74 is a drive element where a piezoelectric body 744 is interposed between a first electrode 742 and a second electrode 746. The drive signal V is supplied to one of the first electrode 742 and the second electrode 746, and a predetermined reference potential VM is supplied to the other electrode. When the piezoelectric element 74 is deformed by the supply of the drive signal V and the vibration plate 73 vibrates, the pressure in the pressure chamber SC varies and the ink in the pressure chamber SC is discharged from the nozzle N. Specifically, a discharge amount of ink in accordance with an amplitude of the drive signal V is discharged from the nozzle N. One discharge unit 266 illustrated in FIG. 4 is a part including the piezoelectric element 74, the vibration plate 73, the pressure chamber SC, and the nozzle N.

The electrode, which is one of the first electrode 742 and the second electrode 746, to which the reference potential VM is supplied may be a common electrode over a plurality of piezoelectric elements 74. In this way, in the configuration of FIG. 4, the piezoelectric element 74 is deformed by the supply of the drive signal V to vary the pressure in the pressure chamber SC, so that the pressure in the internal space SD of the liquid discharge head 26 varies. Therefore, it is possible to discharge ink from the nozzle N.

Figure 5:
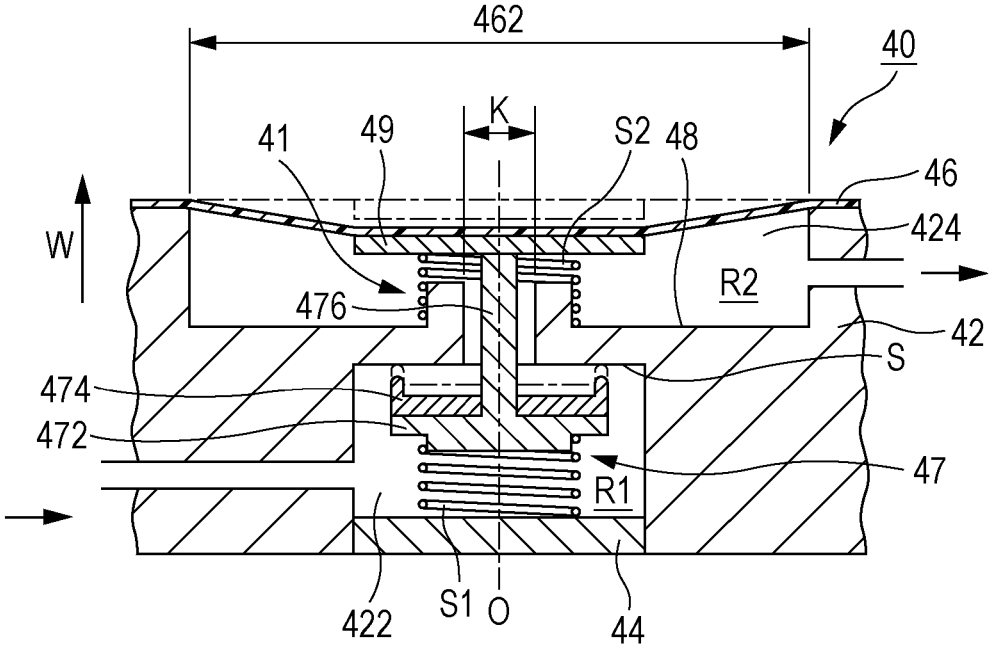
FIG. 5 is a cross-sectional view showing a configuration of a valve apparatus.

FIG. 5 is a cross-sectional view showing a configuration of the valve apparatus 40. The valve apparatus 40 includes a valve body 47, a valve seat 48, a spring S1, and a spring S2. Generally, the valve body 47 moves to a positive side and a negative side in a W direction with respect to the valve seat 48 to perform an attaching/detaching operation to/from the valve seat 48, so that a first flow path R1 is opened/closed. Specifically, when the valve body 47 moves to the positive side in the W direction and comes into contact with the valve seat 48, the first flow path R1 is shut off from a second flow path R2 and the first flow path R1 becomes a closed state. On the other hand, when the valve body 47 moves to the negative side in the W direction and moves away from the valve seat 48, the first flow path R1 communicates with the second flow path R2 and the first flow path R1 becomes an open state.

The valve seat 48 is a portion of the support body 42 located between the first flow path R1 and the second flow path R2 (a bottom portion of a recessed portion 422 or a recessed portion 424). The valve seat 48 faces a movable portion 462 of a flexible film 46 that seals the second flow path R2 with a space in between. A through hole K penetrating the support body 42 is formed at substantially a center of the valve seat 48. The through hole K is a perfect circle hole whose inner circumferential surface is in parallel with the W direction. The first flow path R1 located on the upstream side of the valve seat 48 and the second flow path R2 located on the downstream side of the valve seat 48 communicate with each other through the through hole K of the valve seat 48.

The valve body 47 is installed in the first flow path R1. The valve body 47 is composed of a base portion 472, a sealing portion 474, and a valve shaft 476. The base portion 472 is a flat plate-shaped portion formed into a circular shape whose diameter exceeds the inner diameter of the through hole K. The valve shaft 476 coaxially projects in a vertical direction from a surface of the base portion 472, and the sealing portion 474 having a ring shape surrounding the valve shaft 476 in plan view is mounted on the surface of the base portion 472. The valve body 47 is installed so that the base portion 472 and the sealing portion 474 are located in the first flow path R1 in a state in which the valve shaft 476 whose axis line O is in the W direction is inserted into the through hole K of the valve seat 48. A gap is formed between the inner circumferential surface of the through hole K of the valve seat 48 and the outer circumferential surface of the valve shaft 476. The spring S1 is installed between a sealing body 44 and the base portion 472 of the valve body 47 and energizes the valve body 47 toward the valve seat 48. On the other hand, the spring S2 is installed between the valve seat 48 and a pressure receiving plate 49 (the movable portion 462).

The sealing portion 474 of the valve body 47 is located between the base portion 472 and the valve seat 48 and functions as a seal that closes the through hole K by coming into contact with the valve seat 48. Specifically, the sealing portion 474 comes into contact with a surface (hereinafter referred to as a "sealing surface") S of the valve seat 48 facing the first flow path R1.

According to the valve apparatus 40 having such a configuration, in a state in which the pressure in the second flow path R2 is maintained within a predetermined range, the spring S1 energizes the valve body 47 and thereby a peripheral edge portion of the sealing portion 474 comes into contact with the sealing surface S of the valve seat 48, so that a state in which the valve body 47 closes the through hole K of the valve seat 48 (hereinafter referred to as a "closed state") is maintained as shown by dashed-dotted lines in FIG. 5. In short, the first flow path R1 and the second flow path R2 are shut off from each other. On the other hand, when the pressure in the second flow path R2 is reduced due to, for example, discharge of ink or suction from outside, as shown by solid lines in FIG. 5, the movable portion 462 of the flexible film 46 is displaced toward the valve seat 48 and the pressure receiving plate 49 installed on the movable portion 462 presses the valve shaft 476 of the valve body 47 against energization by the spring S2. In short, the movable portion 462 of the flexible film 46 is displaced in accordance with a differential pressure between both sides of the movable portion 462 (a differential pressure between the upper side and the lower side of the movable portion 462). When the pressure in the second flow path R2 is further reduced, the valve shaft 476 is pressed by the movable portion 462 (the pressure receiving plate 49) and the valve body 47 moves toward the negative side in the W direction (toward the sealing body 44) against energization by the spring S1, so that as shown by solid lines in FIG. 5, the valve apparatus 40 transits to a state in which the sealing portion 474 is separated from the valve seat 48 (hereinafter referred to as a "open state"). In the open state, the through hole K of the valve seat 48 is released, and the first flow path R1 and the second flow path R2 communicate with each other through the through hole K.

According to the valve apparatus 40 as described above, in a non-printing state, that is, in a state where ink is not consumed, even when ink is forcibly fed from a flow path from the liquid container 14 located on the upstream side of the valve apparatus 40, the valve apparatus 40 is in the closed state. Thereby, the ink from the flow path from the liquid container 14 is not supplied to the liquid discharge head 26 located on the downstream side of the valve apparatus 40.

On the other hand, in a printing state, when ink is discharged from the nozzle N and ink is consumed, the pressure is reduced in accordance with decrease of ink in the second flow path R2, so that the second flow path R2 becomes negative pressure. Thereby, the movable portion 462 is displaced to the negative side in the W direction to push down the valve body 47, so that the valve body 47 becomes the open state and ink is supplied from the first flow path R1 to the second flow path R2. In this way, the ink from the flow path from the liquid container 14 is supplied to the liquid discharge head 26. When the negative pressure in the second flow path R2 is eliminated by an inflow of the ink into the second flow path R2 of the valve apparatus 40, the movable portion 462 is displaced to the positive side in the W direction as shown by dashed-dotted lines in FIG. 5, the valve body 47 is restored, the valve body 47 becomes the closed state again, and the supply of the ink to the liquid discharge head 26 is stopped.

By the way, in the valve apparatus 40 having the configuration as described above, in a very small space which is formed when the valve body 47 and the valve seat 48 come into contact with each other and which has been formed by repetitive contact of the valve body 47 to the valve seat 48, components contained in ink are accumulated, and the components are agglomerated by being compressed and dehydrated. There is a problem that the agglomerated ink adheres to the valve body 47 and the valve seat 48 to be deposited on them and thereby a deposit occurs. Further, when an SP value (compatibility parameter) of the deposit composed of ink components is a value close to an SP value of a valve seat constituent material and the compatibility with the valve seat constituent material is high, the deposit is difficult to be peeled off from the valve seat 48, so that the deposit is directly fixed on the valve seat 48 and enters into a growth process. When the deposit grows and the amount of deposit increases, a gap occurs in a contact surface between the valve body 47 and the valve seat 48, so that there is a risk that a closing failure of the valve body 47 occurs. In particular, when the closing failure of the valve body 47 occurs in the liquid discharge apparatus 10, ink leakage occurs from the valve body 47. If ink leakage occurs at the valve apparatus 40 when ink is pressurized and supplied from the pressurization supply unit 30 to the liquid discharge head 26, the pressure is transmitted to a flow path in the liquid discharge head 26 and an excessive pressure is applied in the liquid discharge head 26 (the pressure chamber SC, the liquid reservoir chamber SR, and the like).

When the piezoelectric element 74 is driven and the vibration plate 73 is vibrated in a state in which an excessive pressure is applied in the liquid discharge head 26 in this way, there is a risk that a crack occurs in the vibration plate 73 and the vibration plate 73 is damaged. When an ink leakage occurs at the valve apparatus 40 when the ink is pressurized and supplied from the pressurization supply unit 30, the pressure of the ink is transmitted to the pressure chamber SC shown in FIG. 4 and a force for expanding the vibration plate 73, which constitutes a part of the pressure chamber SC, toward a surface opposite to the pressure chamber SC (toward the piezoelectric element 74) is applied to the vibration plate 73. In this state, when the piezoelectric element 74 is driven to bend the vibration plate 73 of the pressure chamber SC, the vibration plate 73 is forcibly displaced from a state in which an excessively pressurized pressure is applied from the pressure chamber SC to the vibration plate 73. Therefore, a surplus dynamic load is applied to the vibration plate 73, so that there is a risk that a crack occurs at a region near a portion, where the vibration plate 73 is fixed and a stress concentration tends to occur, to cause a damage.

However, in the related art configuration described above, it is not possible to specifically know whether or not ink leakage occurs in the valve apparatus 40 and an excessive pressure is applied to the ink in the pressure chamber SC. For example, when an excessive pressure is applied to the pressure chamber SC and liquid dripping from the nozzle N occurs, a printing failure such as dot omission occurs. Therefore, when a user performs cleaning so as to eliminate the printing failure and prints a check pattern to confirm a cleaning effect, the piezoelectric element 74 is driven in a state in which an excessive pressure is applied to the pressure chamber SC. In this case, while the printing failure can be eliminated by only replacing the valve apparatus 40, a failure of the liquid discharge head 26 such as damage of the vibration plate 73 is caused, so that there is a risk that the liquid discharge head 26 is required to be exchanged.

Therefore, in the present embodiment, a pressure condition in the liquid discharge head 26 is detected, and drive of the piezoelectric element 74 is restricted in accordance with the pressure condition. Therefore, in an abnormal pressure condition such as when an excessive pressure is applied in the liquid discharge head 26 due to a closing failure or the like of the valve apparatus 40, it is possible to restrict the drive of the piezoelectric element 74. Therefore, it is possible to suppress vibration of the vibration plate 73 in a state in which an excessive pressure is applied, so that generation of a crack in the vibration plate 73 can be suppressed. Thereby, even when ink leakage occurs in the valve apparatus 40, the vibration plate 73 is not damaged, so that it is possible not to cause a failure of the liquid discharge head 26.

A detection unit 28 in FIG. 2 detects the pressure condition in the liquid discharge head 26 and outputs a state signal VS to the determination unit 52. For example, during printing standby, in the case of an abnormal pressure condition in which an excessive pressure is applied in the liquid discharge head 26 (the pressure chamber SC and the liquid reservoir chamber SR), the flexible film 772 of the compliance unit 77 is displaced into the damper chamber SG as shown by dotted lines in FIG. 4. Therefore, it is possible to detect the pressure condition in the liquid discharge head 26 from the displacement of the flexible film 772 as described above. Therefore, the detection unit 28 of the first embodiment detects the pressure condition in the liquid discharge head 26 from the displacement of the flexible film 772 of the compliance unit 77.

Specifically, as shown in FIG. 4, the detection unit 28 of the first embodiment is composed of a displacement sensor that detects a displacement of the flexible film 772 of the compliance unit 77. The detection unit 28 in FIG. 4 includes a terminal a to which the flexible film 772 is connected, a terminal b to which the fixation plate 78 is connected, a terminal c that detects a voltage V, and a switch d that switches between a connection of the terminal a with the terminal b and a connection of the terminal a with the terminal c. The fixation plate 78 and the terminal b are grounded. When the terminal a and the terminal c are connected by the switch d, an electrostatic capacitance between the flexible film 772 and the fixation plate 78 changes in accordance with the displacement of the flexible film 772, so that the voltage of the terminal c also changes.

By using such a change of the electrostatic capacitance caused by the displacement of the flexible film 772, the displacement of the flexible film 772 can be indirectly detected. Specifically, the flexible film 772 and the fixation plate 78 can be equivalent to a capacitor of parallel flat plates where the flexible film 772 and the fixation plate 78 are used as electrodes, so that when the electrostatic capacitance of the capacitor is C and the electric charge of the capacitor is Q, a voltage V of the terminal c (a voltage between the flexible film 772 and the fixation plate 78) can be represented as $V=Q/C$. According to this, the more the flexible film 772 is displaced toward the damper chamber SG, the smaller the gap between the flexible film 772 and the fixation plate 78 is, so that the electrostatic capacitance C increases and the voltage V of the terminal c decreases. Therefore, in a state in which an excessive pressure is applied in the liquid discharge head 26, the gap between the flexible film 772 and the fixation plate 78 is smaller than that in a state in which no excessive pressure is applied, so that the voltage V of the terminal c is also small. Therefore, when the voltage V of the terminal c is used as the state signal VS, the pressure condition in the liquid discharge head 26 can be determined from the displacement of the flexible film 772. For the detection of the electrostatic capacitance, it is possible to use a publicly known method such as, for example, an RC oscillation method that utilizes charging and discharging by a resistance and a measuring capacitance and a method that inserts a measuring capacitance into one side of an AC bridge. By using these methods, it is possible to perform highly accurate detection of the electrostatic capacitance.

As described above, in a state in which an excessive pressure is applied in the liquid discharge head 26, the state signal VS (the voltage V of the terminal c) is smaller than that in a state in which no excessive pressure is applied in the liquid discharge head 26. Therefore, when the state signal VS exceeds a threshold value, the determination unit 52 in FIG. 2 determines that no excessive pressure is applied in the liquid discharge head 26, and when the state signal VS does not exceed the threshold value, the determination unit 52 determines that an excessive pressure is applied in the liquid discharge head 26.

When the determination unit 52 determines that no excessive pressure is applied in the liquid discharge head 26, the controller 50 drives the piezoelectric element 74, and when the determination unit 52 determines that an excessive pressure is applied in the liquid discharge head 26, the controller 50 restricts driving of the piezoelectric element 74.

In this way, the flexible film 772 of the compliance unit 77 of the present embodiment plays not only a role as a film that suppresses pressure change in the liquid reservoir chamber SR and the flow path, but also a role as a film that detects the pressure condition in the liquid discharge head 26. Further, the pressure condition in the liquid discharge head 26 is detected from the displacement of the flexible film 772 of the compliance unit 77, so that it is not necessary to separately provide a pressure sensor or the like. The flexible film 772 can be a grounding potential (ground potential) by connecting the terminal a with the terminal b by the switch d of the detection unit 28, so that it is possible to release excessive electric charges accumulated in the flexible film 772. Thereby, the displacement of the flexible film 772 can be accurately detected, and it is also possible to suppress adhesion of the flexible film 772 to the fixation plate 78 due to an electrostatic force of the excessive electric charges accumulated in the flexible film 772.

Although a case is illustrated where the detection unit 28 of the present embodiment is composed of a displacement sensor that detects a displacement of the flexible film 772 of the compliance unit 77, the detection unit 28 may be composed of an optical sensor that emits light to the flexible film 772 and receives its reflected light. According to this configuration, the amount of received reflected light changes due to the displacement of the flexible film 772, so that the determination unit 52 can determine the pressure condition of the liquid discharge head 26 by using a voltage signal that varies according to the amount of received light as the state signal VS.

Figure 6:
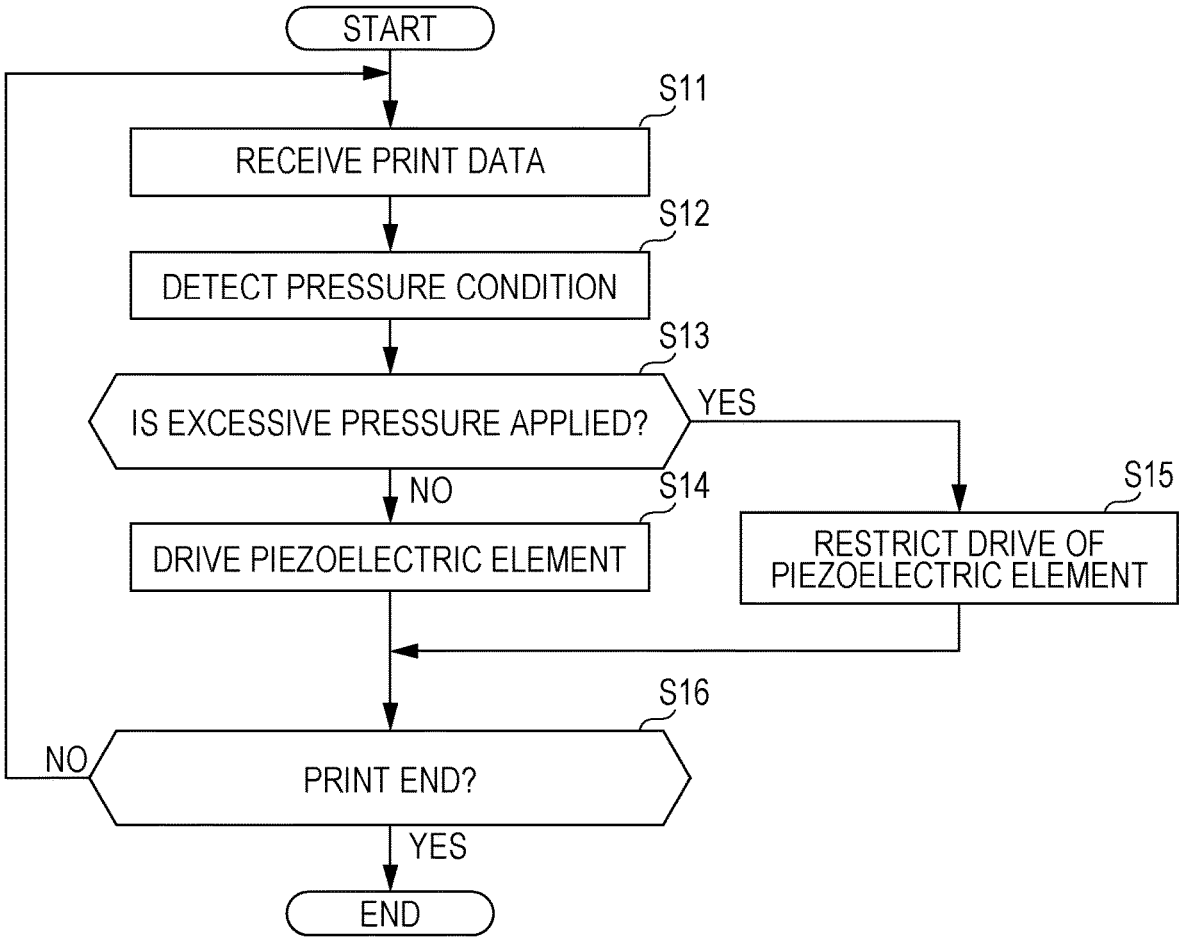
FIG. 6 is a flowchart showing control of the liquid discharge apparatus during printing.

Next, a control method of the liquid discharge apparatus 10 of the first embodiment will be described with reference to the drawings. FIG. 6 is a flowchart showing the control of the liquid discharge apparatus 10 during printing. As shown in FIG. 6, when the receiving unit 53 receives print data G in step S11, the controller 50 causes the detection unit 28 to detect the pressure condition in the liquid discharge head 26 and outputs the state signal VS to the determination unit 52 in step S12. When the receiving unit 53 receives the print data G, for example, before the drive waveform W that vibrates the vibration plate 73 is supplied to the piezoelectric element 74, the detection unit 28 switches the switch d, connects the terminal a with the terminal c, and supplies the state signal VS to the determination unit 52. Then, in step S13, the determination unit 52 determines whether or not an excessive pressure is applied in the liquid discharge head 26 on the basis of the state signal VS from the detection unit 28.

When the determination unit 52 determines that no excessive pressure is applied in the liquid discharge head 26 in step S13, the controller 50 drives the piezoelectric element 74 to print the print data G in step S14. Then, in step S16, the controller 50 determines whether or not the print ends, and when determining that the print does not end, the controller 50 receives next print data G in step S11. When the controller 50 determines that the print ends in step S16, the controller 50 ends print processing.

On the other hand, when the determination unit 52 determines that an excessive pressure is applied in the liquid discharge head 26 in step S13, the controller 50 restricts driving of the piezoelectric element 74 in step S15. At this time, the controller 50 restricts input of the drive waveform W that drives the vibration plate 73 into the piezoelectric element 74 and causes the piezoelectric element 74 not to be driven. The controller 50 may drive the piezoelectric element 74 while reducing a discharge amount. When the controller 50 does not drive the piezoelectric element 74, the controller 50 may inform a user that a component is required to be replaced. The controller 50 may encourage the user to remove the liquid container 14 in order to prevent printing.

Specifically, as shown in FIG. 2, the liquid discharge apparatus 10 is composed of a touch panel, includes an operation panel 60 having a display unit 62, and can display a message encouraging a user to replace a component on the display unit 62. Thereby, in a state in which an excessive pressure is applied in the liquid discharge head 26, the piezoelectric element 74 is not driven, so that it is possible to suppress generation of a crack in the vibration plate 73.

The operation panel 60 is an operation panel where a user can perform various operations. A plurality of buttons (not shown in the drawings) and a selection button for selecting an operation mode are displayed on the operation panel 60. The user can select an operation by touching a button displayed on the display unit 62. The controller 50 performs an operation associated with a button selected by the user. By using the operation panel 60, a message encouraging the user to change to an operation mode where the discharge amount can be reduced may be displayed instead of a message encouraging the user to replace a component. In this operation mode, print is performed while reducing the discharge amount of ink by changing the discharge amount of ink per unit time (print duty) with respect to a unit area of the medium 12 by, for example, changing the drive waveform W or changing a dot size. Thereby, even when an excessive pressure is applied in the liquid discharge head 26, it is possible to suppress vibration of the vibration plate 73 caused by driving of the piezoelectric element 74, so that the generation of a crack in the vibration plate 73 can be suppressed.

Further, it is possible to let the user select replacement of component and change of operation mode. Specifically, the controller 50 displays a button for selecting replacement of component or change of operation mode on the display unit 62. When the user selects the replacement of component, the controller 50 ends print without printing the print data G. When the user selects the change of operation mode, the controller 50 transits to an operation mode where the discharge amount of ink is reduced and the piezoelectric element 74 is driven, and prints the print data G. In step S16, the controller 50 determines whether or not the print ends, and when determining that the print does not end, the controller 50 receives next print data G in step S11. When the controller 50 determines that the print ends, the controller 50 ends the print processing. When the user selects the replacement of component, the controller 50 does not print the print data G, determines that the print ends in step S16, and ends the print processing.

According to the present embodiment as described above, in an abnormal pressure condition such as when an excessive pressure is applied in the liquid discharge head 26 due to a closing failure or the like of the valve apparatus 40, it is possible to restrict the drive of the piezoelectric element 74. Therefore, it is possible to suppress vibration of the vibration plate 73 in a state in which an excessive pressure is applied in the liquid discharge head 26 (the pressure chamber SC and the like), so that generation of a crack in the vibration plate 73 can be suppressed.

The present embodiment illustrates a case where the pressure condition in the liquid discharge head 26 is detected from the displacement of the flexible film 772 of the compliance unit 77. However, the detection method of the pressure condition is not limited to this. For example, in a case where a closing failure of the valve body 47 occurs in the valve apparatus 40 in FIG. 5, a displacement amount of the flexible film 46 is different as compared with a case where no closing failure occurs, so that it is possible to detect the pressure condition in the liquid discharge head 26 from the displacement of the flexible film 46 of the valve apparatus 40.

The detection unit 28 in FIG. 2 may be configured so as to detect residual vibration when the piezoelectric element 74 is driven without using a position sensor and an optical sensor. In an abnormal pressure condition such as when an excessive pressure is applied to the pressure chamber SC, the vibration plate 73 is more difficult to bend toward the pressure chamber SC than in a normal pressure condition where no excessive pressure is applied. Therefore, in a case where an excessive pressure is applied to the pressure chamber SC, as compared with a case where no excessive pressure is applied, when the piezoelectric element 74 is driven, a waveform where generation of residual vibration is suppressed is obtained. Therefore, signals such as period, amplitude, and phase of the residual vibration are different between a state in which an excessive pressure is applied in the liquid discharge head 26 and a state in which no excessive pressure is applied in the liquid discharge head 26. Therefore, it is possible to determine a pressure condition of the liquid discharge head 26 by using these signals as the state signal VS. In this way, the detection unit 28 detects the pressure condition in the liquid discharge head 26 from the residual vibration due to the drive of the piezoelectric element 74, so that it is not necessary to separately provide a pressure sensor or the like. Further, it is not necessary to provide a position sensor or an optical sensor for detecting the displacement of the flexible film 772 and the like, so that it is possible to reduce the number of components.

Second Embodiment

A second embodiment of the invention will be described. In each form illustrated below, elements whose operation and function are the same as those in the first embodiment are denoted by the same reference numerals as those used in the description of the first embodiment, and detailed description thereof will be appropriately omitted. While the first embodiment illustrates the case where the drive of the piezoelectric element 74 is restricted in accordance with the pressure condition in the liquid discharge head 26, the second embodiment illustrates a case where the pressure in the liquid discharge head 26 is reduced in accordance with the pressure condition in the liquid discharge head 26.

Figure 7:
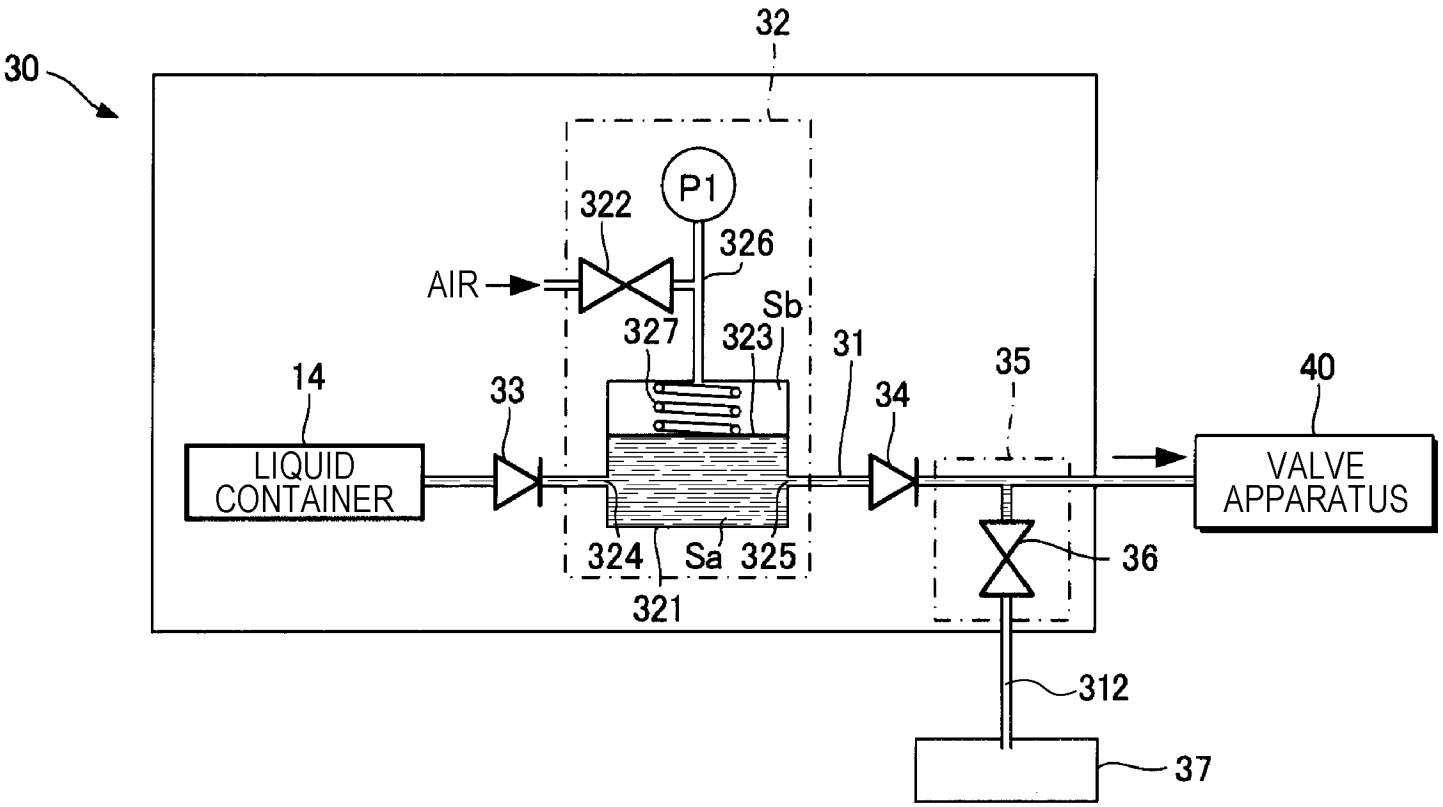
FIG. 7 is a diagram showing a flow path configuration of a pressurization supply unit of a second embodiment.
Figure 8:
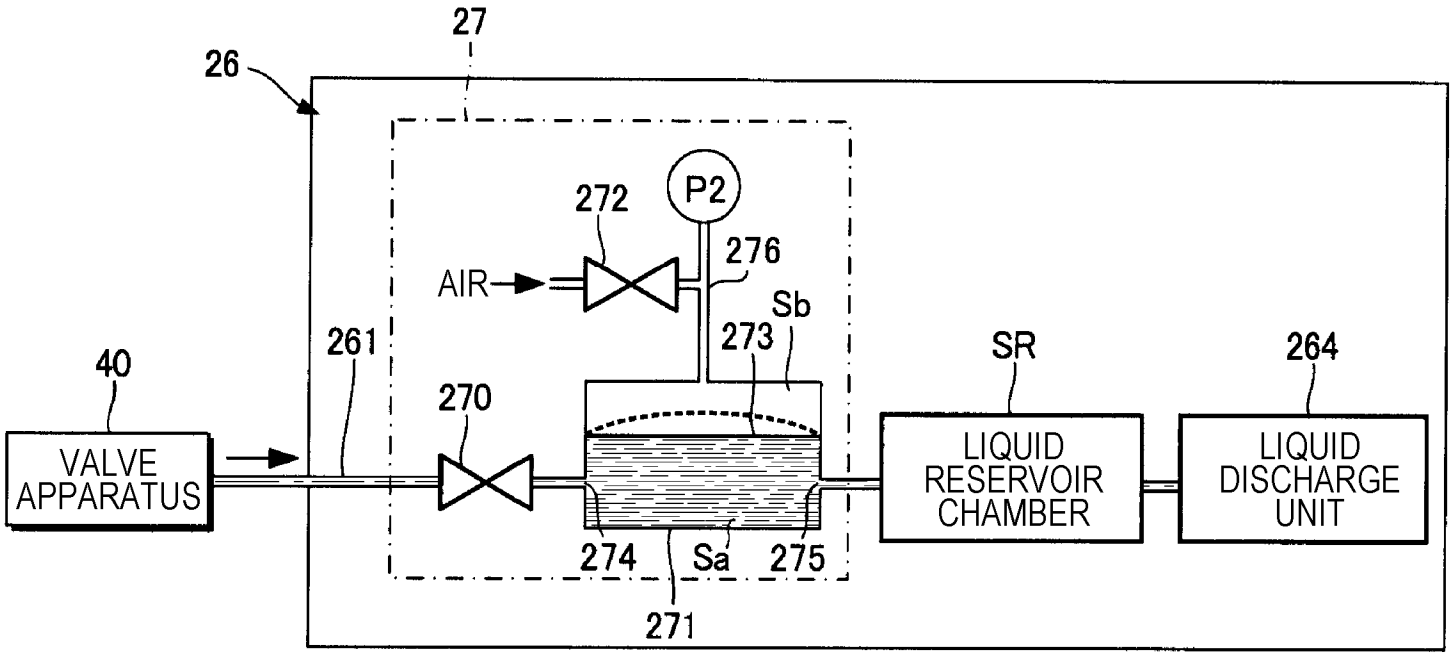
FIG. 8 is a diagram showing a flow path configuration of a liquid discharge head of the second embodiment.

FIG. 7 is a diagram showing a flow path configuration of the pressurization supply unit 30 of the second embodiment. FIG. 8 is a diagram showing a flow path configuration of the liquid discharge head 26 of the second embodiment. The pressurization supply unit 30 in FIG. 7 includes a pressurization mechanism 32, a pressurization reduction mechanism 35, and check valves 33 and 34. The pressurization mechanism 32, the pressurization reduction mechanism 35, and the check valves 33 and 34 are provided on a flow path 31 that makes the liquid container 14 and the valve apparatus 40 communicate with each other. The pressurization mechanism 32 pressurizes ink from the liquid container 14. The pressurization reduction mechanism 35 reduces the pressurization of the ink. The present embodiment illustrates a case where the pressurization mechanism 32 is arranged on the upstream side of the flow path 31 and the pressurization reduction mechanism 35 is arranged on the downstream side of the pressurization mechanism 32. The check valve 33 is interposed on the upstream side of the pressurization mechanism 32, that is, between the liquid container 14 and the pressurization mechanism 32. The check valve 34 is interposed on the downstream side of the pressurization mechanism 32, that is, between the pressurization mechanism 32 and the valve apparatus 40.

The pressurization mechanism 32 includes a buffer chamber 321 and a pump P1. The buffer chamber 321 is divided into a liquid chamber Sa and a gas chamber Sb by the flexible film 323. An inflow port 324 and an outflow port 325 of ink communicate with the liquid chamber Sa. The pump P1 is connected to the gas chamber Sb through a gas flow path 326. The pump P1 is a pump that depressurizes the inside of the gas chamber Sb. The pump P1 is typically composed of a pneumatic pump. The pump P1 is driven by the controller 50. An atmospheric air opening valve 322 that makes the gas chamber Sb communicate with the atmosphere is connected to a middle of the gas flow path 326. In the gas chamber Sb, a spring 327 is provided that energizes the flexible film 323 in a direction in which ink is pressurized (downward in FIG. 5). The spring 327 is provided, so that when the depressurization of the pump P1 is reduced, the ink can be pressurized by a pressurizing force of the spring 327, and when the depressurization of the pump P1 is increased, the pressurizing force of the spring 327 can be weakened. The spring 327 need not necessarily be provided.

According the pressurization mechanism 32 having a configuration as described above, the inside of the gas chamber Sb is depressurized by the pump P1 in a state in which the atmospheric air opening valve 322 is closed, so that the flexible film 323 is displaced upward in FIG. 7 and ink is drawn from the liquid container 14 to the liquid chamber Sa, and the depressurization by the pump P1 is stopped and the atmospheric air opening valve 322 is opened, so that the flexible film 323 is displaced downward in FIG. 7 and the ink is pressurized. Thereby, the ink from the liquid container 14 flows in from the inflow port 324, is pressurized in the buffer chamber 321, flows out from the outflow port 325, and is supplied to the valve apparatus 40. A force for pushing out the ink can be weakened by adjusting the pressure of the pump P1 and the timing of opening the atmospheric air opening valve 322, so that it is possible to reduce pressurization of the ink to be supplied to the inside of the liquid discharge head 26. Therefore, even when an excessive pressure is applied in the liquid discharge head 26 due to a closing failure or the like of the valve apparatus 40, the pressure transmitted to the inside of the liquid discharge head 26 can be reduced when the pressurization mechanism 32 releases an excessive pressure of ink to be supplied to the liquid discharge head 26. In this way, the atmospheric air opening valve 322 can be functioned as a control valve that reduces the pressure in the liquid discharge head 26.

The pressurization reduction mechanism 35 of the second embodiment is provided on the downstream side of the check valve 34 on the flow path 31. The pressurization reduction mechanism 35 is composed of a waste liquid valve 36 that opens/closes a flow path 312 that branches from the flow path 31 and communicates with a waste liquid tank 37. When the waste liquid valve 36 opens the flow path 312, the ink flowing through the flow path 31 flows into the waste liquid tank 37, so that the pressurization of the ink flowing to the valve apparatus 40 can be reduced, and when the waste liquid valve 36 closes the flow path 312, the pressurization of the ink flowing to the valve apparatus 40 can be restored. According to this configuration, the pressurization of the ink to be supplied to the liquid discharge head 26 can be reduced by opening the waste liquid valve 36. Therefore, even when an excessive pressure is applied in the liquid discharge head 26 due to a closing failure or the like of the valve apparatus 40, the pressure transmitted to the inside of the liquid discharge head 26 can be reduced when the pressurization reduction mechanism 35 releases an excessive pressure of ink to be supplied to the liquid discharge head 26. In this way, the waste liquid valve 36 can be functioned as a control valve that reduces the pressure in the liquid discharge head 26.

As shown in FIG. 8, the liquid discharge head 26 of the second embodiment includes a negative pressure release mechanism 27 that can release a negative pressure in the liquid discharge head 26 and pressurize ink by displacing a flexible film 273. The negative pressure release mechanism 27 is provided on a flow path 261 that makes the valve apparatus 40 and the liquid reservoir chamber SR communicate with each other. The negative pressure release mechanism 27 can release the negative pressure in the liquid discharge head 26 and pressurize the inside of the liquid discharge head 26. For example, it is possible to wipe the discharge surface 260 while exuding ink from the nozzle N by pressurizing the inside of the liquid discharge head 26 by the negative pressure release mechanism 27 during cleaning. Thereby, it is possible to remove adhering materials such as high-viscosity ink and paper powder which are adhered to the vicinity of the nozzle N without putting them into the nozzle N.

The negative pressure release mechanism 27 includes a choke valve 270, a buffer chamber 271, and a pump P2. The choke valve 270 is provided on the upstream side of the flow path 261, and the buffer chamber 271 is provided on the downstream side of the flow path 261. The choke valve 270 functions as a control valve that opens/closes the flow path 261. The buffer chamber 271 is divided into a liquid chamber Sa and a gas chamber Sb by the flexible film 273. An inflow port 274 and an outflow port 275 of ink communicate with the liquid chamber Sa. The pump P2 is connected to the gas chamber Sb through a gas flow path 276. The pump P2 is a pump that pressurizes the inside of the gas chamber Sb. The pump P2 is typically composed of a pneumatic pump. The pump P2 is driven by the controller 50. An atmospheric air opening valve 272 that makes the gas chamber Sb communicate with the atmosphere is connected to a middle of the gas flow path 276.

According to such a negative pressure release mechanism 27, during printing, the choke valve 270 and the negative pressure release mechanism 27 communicate with the atmosphere and ink is not pressurized. During cleaning, ink can be pressurized by closing the choke valve 270 and pressurizing the ink by the pump P2 of the negative pressure release mechanism 27. Thereby, ink can be exuded from the nozzle N, so that it is possible to improve a cleaning effect of the discharge surface 260.

Further, for example, during printing standby, in the case of an abnormal pressure condition in which an excessive pressure is applied in the liquid discharge head 26 (the pressure chamber SC and the liquid reservoir chamber SR), the flexible film 273 of the negative pressure release mechanism 27 is displaced into the gas chamber Sb as shown by a dotted line in FIG. 8 as compared with a case where the pressure condition is normal (a solid line in FIG. 8). Therefore, it is possible to detect the pressure condition in the liquid discharge head 26 from the displacement of the flexible film 273 of the negative pressure release mechanism 27. Thus, the detection unit 28 of the second embodiment detects the pressure condition in the liquid discharge head 26 from the displacement of the flexible film 273 of the negative pressure release mechanism 27. The detection unit 28 can be composed of a position sensor or an optical sensor in the same manner as in the first embodiment. In this way, the flexible film 273 of the negative pressure release mechanism 27 of the second embodiment plays not only a role as a film that generates pressure change in the flow path 261 by pressurizing ink, but also a role as a film that detects the pressure condition in the liquid discharge head 26.

Figure 9:
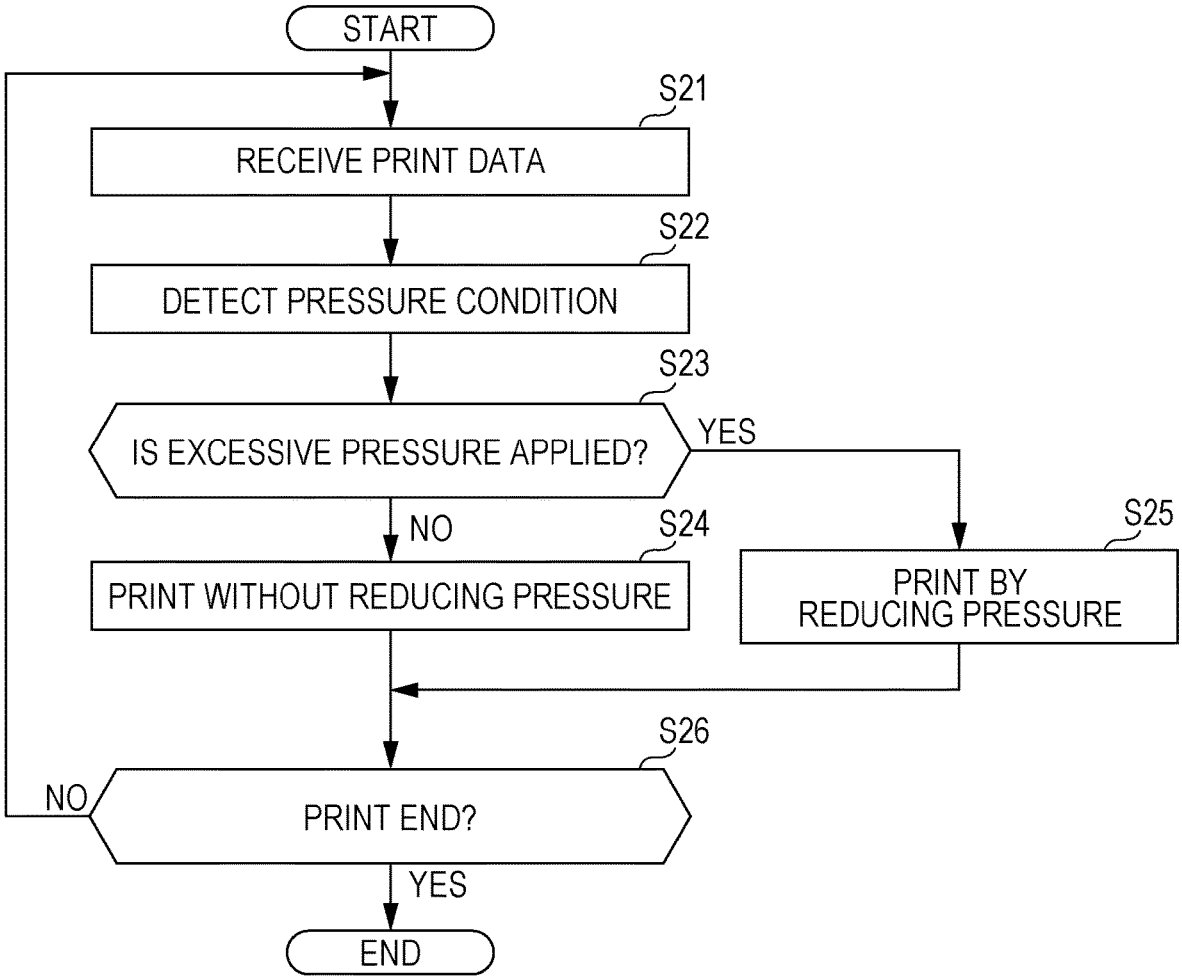
FIG. 9 is a flowchart showing control of a liquid discharge apparatus of the second embodiment during printing.

Next, a control method of the liquid discharge apparatus 10 of the second embodiment will be described with reference to the drawings. FIG. 9 is a flowchart showing control of the liquid discharge apparatus 10 during printing. The processing of steps S21 to S23 shown in FIG. 9 is the same as that of steps S11 to S13 in FIG. 6 and the processing of step S26 shown in FIG. 9 is the same as that of step S16 in FIG. 6, so that detailed description of these steps will be omitted. In the flowchart of FIG. 9, when the determination unit 52 determines that no excessive pressure is applied in the liquid discharge head 26 in step S23, the controller 50 performs print without reducing the pressure of ink pressurized by the pressurization supply unit 30 in step S24. Specifically, the controller 50 performs print of the print data G by driving the piezoelectric element 74 while the flow path 312 is closed by the waste liquid valve 36 and the pressure of ink pressurized by the pressurization supply unit 30 is not reduced.

When the determination unit 52 determines that an excessive pressure is applied in the liquid discharge head 26 in step S23, the controller 50 performs print by reducing the pressure of ink pressurized by the pressurization supply unit 30 in step S25. Specifically, the waste liquid valve 36 opens the flow path 312 and the ink flowing through the flow path 31 flows into the waste liquid tank 37, so that the pressurization of the ink flowing to the valve apparatus 40 is reduced. When the pressure of the ink is reduced to a predetermined pressure, the waste liquid valve 36 closes the flow path 312. Thereby, it is possible to reduce the pressure in the liquid discharge head 26. When the pressure of ink flowing to the valve apparatus 40 is reduced by the pump P1 and the atmospheric air opening valve 322 of the pressurization mechanism 32 while the waste liquid valve 36 closes the flow path 312, it is also possible to reduce the pressure in the liquid discharge head 26.

In this way, in the second embodiment, the pressure in the liquid discharge head 26 can be reduced in accordance with the pressure condition in the liquid discharge head 26. Therefore, in an abnormal pressure condition such as when an excessive pressure is applied in the liquid discharge head 26 due to, for example, a closing failure or the like of the valve apparatus 40, it is possible to perform print while reducing the pressure. Therefore, it is possible to suppress vibration of the vibration plate 73 in a state in which an excessive pressure is applied in the liquid discharge head 26, so that generation of a crack in the vibration plate 73 can be suppressed.

In the second embodiment, the pressurization reduction mechanism 35 composed of the waste liquid valve 36 is a constituent element of the pressurization supply unit 30 and is provided on the upstream side of the valve apparatus 40. Therefore, the pressure on the upstream side of the valve apparatus 40 can be easily controlled by the waste liquid valve 36 and the waste liquid valve 36 can be easily arranged, so that the degree of freedom in arrangement is high, and further it is possible to suppress backflow of ink from the downstream side of the valve apparatus 40. The pressurization reduction mechanism 35 is not limited to this configuration, but the pressurization reduction mechanism 35 may be provided on the downstream side of the valve apparatus 40 without including the pressurization reduction mechanism 35 in the pressurization supply unit 30. When the pressurization reduction mechanism 35 is provided on the downstream side of the valve apparatus 40, a response when reducing the pressure of the liquid discharge head 26 is better than that when the pressurization reduction mechanism 35 is provided on the upstream side of the valve apparatus 40. On the other hand, the pressure on the upstream side of the valve apparatus 40 cannot be reduced, and when the pressurization reduction mechanism 35 is provided in the liquid discharge head 26, the flow path is complicated, so that there is a risk that the position and size of the waste liquid tank 37 are limited. Therefore, it is more preferable to provide the pressurization reduction mechanism 35 on the upstream side of the valve apparatus 40 than on the downstream side of the valve apparatus 40.

When the pressurization reduction mechanism 35 is provided on the downstream side of the valve apparatus 40, the pressurization reduction mechanism 35 may be provided on the upstream side of the negative pressure release mechanism 27 of FIG. 8 (between the negative pressure release mechanism 27 and the choke valve 270) or on the downstream side of the negative pressure release mechanism 27 of FIG. 8 (between the negative pressure release mechanism 27 and the liquid reservoir chamber SR). When the pressurization reduction mechanism 35 is provided on the upstream side of the negative pressure release mechanism 27 of FIG. 8, the valve apparatus 40 can be easily actuated because the flow path resistance on the downstream side of the valve apparatus 40 is small. Therefore, the valve body 47 responds quickly and a flow rate of waste liquid can be increased. Thus, there is an effect that even when a foreign object occurs on the waste liquid valve 36, the foreign object can be removed by a filter of the liquid discharge head 26.

On the other hand, when the pressurization reduction mechanism 35 is provided on the downstream side of the negative pressure release mechanism 27 of FIG. 8, if the ink is circulated in the liquid reservoir chamber SR, the flow path of the waste liquid valve 36 can be also used as a circulation path. On the other hand, the flow path resistance on the downstream side of the valve apparatus 40 increases by the flow path resistance of the negative pressure release mechanism 27, so that a response when opening the valve apparatus 40 lowers and the flow rate of waste liquid decreases. Therefore, when the pressurization reduction mechanism 35 is provided on the downstream side of the valve apparatus 40, it is more preferable to provide the pressurization reduction mechanism 35 on the upstream side of the negative pressure release mechanism 27 of FIG. 8 than on the downstream side of the negative pressure release mechanism 27.

As described above, in the second embodiment, a case is illustrated where the pressurization reduction mechanism 35 is composed of the waste liquid valve 36. However, the pressurization reduction mechanism 35 is not limited to this, and the pressurization reduction mechanism 35 may be composed of a negative pressure generating unit that generates a negative pressure in ink as in a first modified example of the pressurization supply unit 30 shown in FIG. 10. When the pressurization reduction mechanism 35 composed of the negative pressure generating unit is provided on the downstream side of the pressurization mechanism 32, it is possible to lower the pressure of ink pressurized by the pressurization mechanism 32 to lower than a predetermined pressure by the negative pressure generating unit and forcibly feed the ink to the valve apparatus 40.

Figure 10:
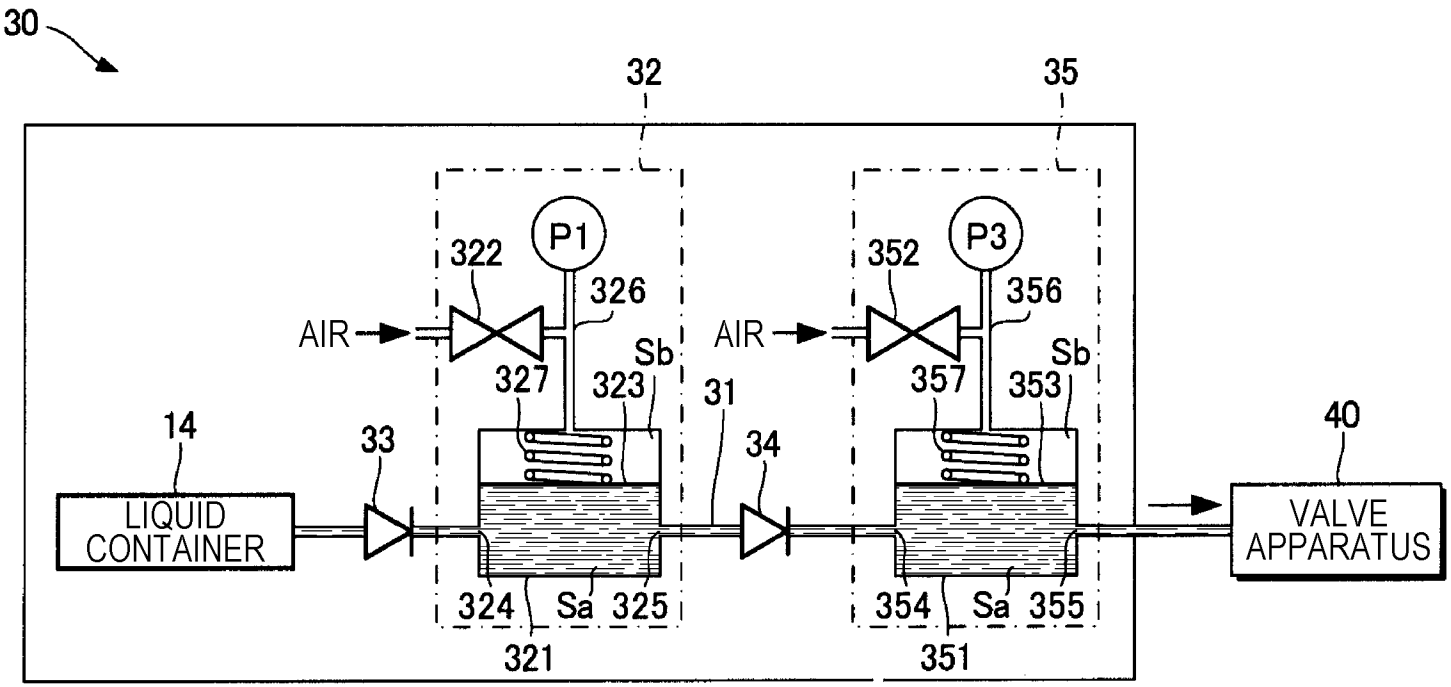
FIG. 10 is a diagram showing a first modified example of the pressurization supply unit.

The pressurization reduction mechanism 35 of FIG. 10 includes a buffer chamber 351 and a pump P3. The buffer chamber 351 is divided into a liquid chamber Sa and a gas chamber Sb by a flexible film 353. An inflow port 354 and an outflow port 355 of ink communicate with the liquid chamber Sa. The pump P3 is connected to the gas chamber Sb through a gas flow path 356. The pump P3 is a pump that depressurizes the inside of the gas chamber Sb. The pump P3 is typically composed of a pneumatic pump. The pump P3 is driven by the controller 50. An atmospheric air opening valve 352 that makes the gas chamber Sb communicate with the atmosphere is connected to a middle of the gas flow path 356. In the gas chamber Sb, a spring 357 is provided that energizes the flexible film 353 in a direction in which ink is pressurized (downward in FIG. 10). The spring 357 is provided, so that when the depressurization of the pump P3 is reduced by opening the atmospheric air opening valve 352, the ink can be pressurized by a pressurizing force of the spring 357, and when the depressurization of the pump P1 is increased by closing the atmospheric air opening valve 352, the pressurizing force of the spring 357 can be weakened. The spring 357 need not necessarily be provided.

According the pressurization supply unit 30 of FIG. 10, the inside of the gas chamber Sb is depressurized by the pump P1 in a state in which the atmospheric air opening valve 322 is closed by the pressurization mechanism 32, so that the ink in the liquid container 14 is moved to the liquid chamber Sa of the pressurization mechanism 32, and thereafter the operation of the pump P1 is stopped and the atmospheric air opening valve 322 is opened. Thereby, it is possible to pressurize the ink in the liquid chamber Sa of the pressurization reduction mechanism 35 and reduce the pressure of the ink to a predetermined pressure by the pressurization reduction mechanism 35. Specifically, the depressurization by the pump P3 is maintained while the atmospheric air opening valve 352 of the pressurization reduction mechanism 35 is closed, so that the pressurizing force of the spring 357 is reduced. Therefore, the pressure of the ink can be reduced to a predetermined pressure. Thus, the it is possible to reduce the pressure in the liquid discharge head 26. In this way, the atmospheric air opening valve 352 can be functioned as a control valve that reduces the pressure in the liquid discharge head 26.

Figure 11:
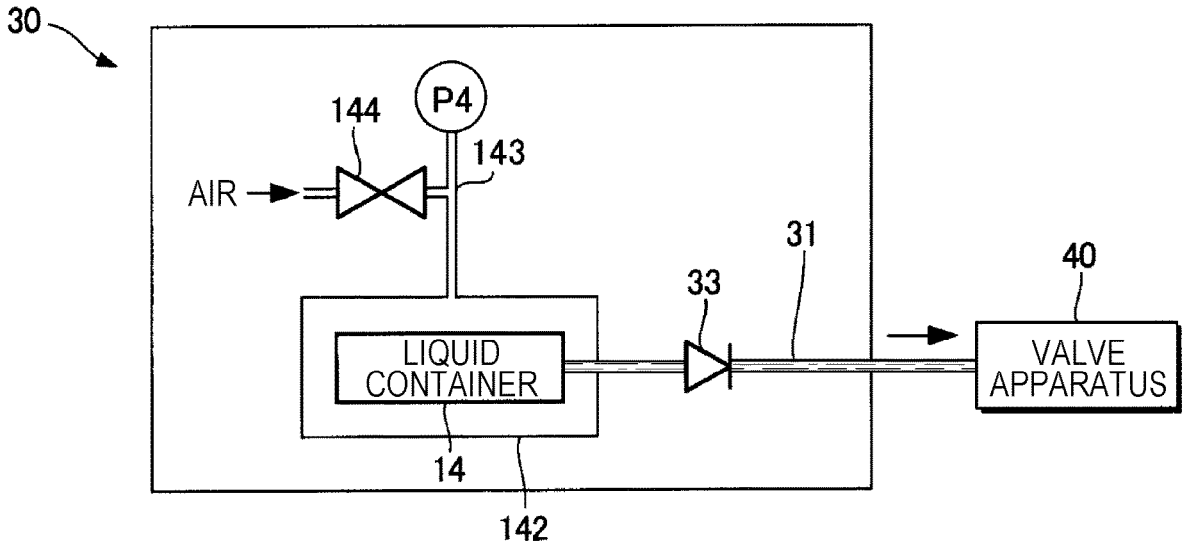
FIG. 11 is a diagram showing a second modified example of the pressurization supply unit.

When the liquid container 14 is composed of an ink pack, the pressurization of the ink may be reduced by adjusting the pressure to be applied to the ink pack. Specifically, as in a second modified example of the pressurization supply unit 30 shown in FIG. 11, the pressure applied to the ink is adjusted by a cartridge 142 mounted with the liquid container 14 composed of an ink pack. A pump P4 is connected to the cartridge 142 through a gas flow path 143. The pump P4 is typically composed of a pneumatic pump and is driven by the controller 50. An atmospheric air opening valve 144 that makes the inside of the cartridge 142 communicate with the atmosphere is connected to a middle of the gas flow path 143. According to the pressurization supply unit 30 of FIG. 11, the pressure of ink can be reduced by adjusting the pressure of the inside of the liquid container 14 by the pump P4. The pressure of ink can also be reduced by opening the atmospheric air opening valve 144. In addition, although not shown in the drawings, when pressurizing and supplying the ink by water head pressure by arranging the liquid container 14 as the pressurization supply unit 30 at a position higher than a position of the liquid discharge head 26 in the gravity direction, it is possible to apply a method of reducing the ink pressure in the liquid discharge head 26 by a mechanism that vertically moves the liquid container 14.

Third Embodiment

A third embodiment of the invention will be described. While the first embodiment and the second embodiment illustrate the case where the drive of the piezoelectric element 74 is restricted and the pressure in the liquid discharge head 26 is reduced in accordance with the pressure condition in the liquid discharge head 26, the third embodiment illustrates a case where the pressure in the liquid discharge head 26 is reduced when print data G is received.

Figure 12:
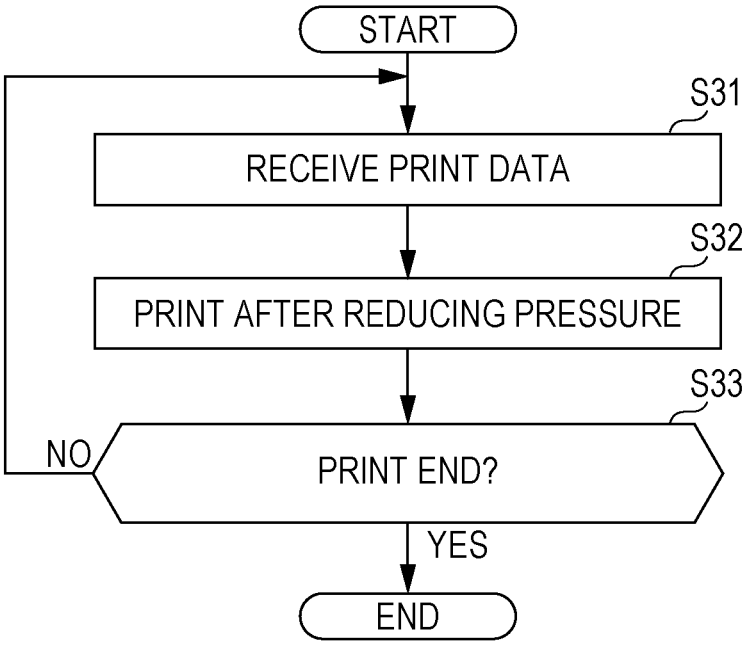
FIG. 12 is a flowchart showing control of a liquid discharge apparatus of a third embodiment during printing.

FIG. 12 is a flowchart showing control of the liquid discharge apparatus 10 of the third embodiment during printing. As shown in FIG. 12, when the receiving unit 53 receives the print data G in step S31, the controller 50 performs print after reducing the pressure of the liquid discharge head 26 in step S32. In the same manner as in the second embodiment, the controller 50 drives the piezoelectric element 74 after reducing the pressure of the liquid discharge head 26 by, for example, the pressurization mechanism 32 and the pressurization reduction mechanism 35 in FIG. 7, the negative pressure release mechanism 27 in FIG. 8, the pressurization reduction mechanism 35 in FIG. 10, and the like. Then, in step S33, the controller 50 determines whether or not the print ends, and when determining that the print does not end, the controller 50 receives next print data G in step S31. When the controller 50 determines that the print ends in step S33, the controller 50 ends print processing.

As described above, according to the third embodiment, the pressure in the liquid discharge head 26 is reduced when the print data G is received, so that it is possible to reduce the pressure in the liquid discharge head 26 before driving the piezoelectric element 74 for the print data G. In this way, it is possible to reduce the pressure in the liquid discharge head 26 in advance, so that even when ink leakage occurs due to a closing failure or the like of the valve apparatus 40, an excessive pressure in the liquid discharge head 26 can be reduced when vibrating the vibration plate 73. Therefore, it is possible to suppress generation of a crack in the vibration plate 73. In the third embodiment, the drive of the piezoelectric element 74 may be restricted and the pressure in the liquid discharge head 26 may be reduced in accordance with the pressure condition in the liquid discharge head 26 as in the second embodiment while reducing the pressure in the liquid discharge head 26 when receiving the print data G.

Fourth Embodiment

A fourth embodiment of the invention will be described. Although the third embodiment illustrates the case where the pressure in the liquid discharge head 26 is reduced when the print data G is received, a supply pressure of ink is controlled in accordance with content of the print data G. If the supply pressure of ink is too much reduced in order to reduce the pressure in the liquid discharge head 26, there is a risk that print where a large amount of ink is discharged cannot be performed.

When the pressure in the liquid discharge head 26 during printing is smaller than (on the negative side, greater than) the negative side withstanding pressure of the meniscus in the nozzle N (for example, −4 Pa with respect to the atmospheric pressure), the meniscus in the nozzle is drawing to the pressure chamber SC and print cannot be performed. Therefore, the pressure of the ink (the supply pressure of ink) in the pressurization supply unit 30 needs to be set large so that the pressure in the liquid discharge head 26 during printing is not lower than the negative side withstanding pressure of the meniscus in the nozzle N. When ink leakage occurs in the valve apparatus 40, the pressure in the liquid discharge head 26 during printing standby is substantially the same as the pressure of the ink in the pressurization supply unit 30, and the pressure in the liquid discharge head 26 during printing is a pressure obtained by subtracting an amount of pressure loss in the entire flow path from the pressure of the ink in the pressurization supply unit 30. Regarding the amount of pressure loss in the entire flow path, the smaller the discharge amount of ink, the smaller the amount of pressure loss, and the larger the discharge amount of ink, the larger the amount of pressure loss. Therefore, in this case, when ink leakage occurs in the valve apparatus 40, the smaller the discharge amount of ink in the print data G, the larger the pressure reduction rate of ink in the pressurization supply unit 30 by which print can be performed, and the larger the discharge amount of ink in the print data G, the smaller the pressure reduction rate of ink in the pressurization supply unit 30 by which print can be performed.

Therefore, in the fourth embodiment, the larger the discharge amount (consumption amount) of ink by the print data G, the higher the supply pressure of ink by the pressurization supply unit 30, and the smaller the discharge amount of ink by the print data G, the lower the supply pressure of ink by the pressurization supply unit 30. The discharge amount of ink of the print data G is the discharge amount of ink per unit time (print duty) with respect to a unit area of the medium 12. The discharge amount of ink of the print data G is not limited to this, but may be an average discharge amount per unit time or may be a median of the discharge amount per unit time. The discharge amount of ink by the print data G may be determined for each discharge unit 266.

In the fourth embodiment, the controller 50 of FIG. 2 determines the discharge amount of ink by the print data G received from the receiving unit 53 and controls the pressure of ink by the pressurization supply unit 30 according to the discharge amount of ink. The supply pressure of ink by the pressurization supply unit 30 can be controlled by, for example, the pressurization mechanism 32 and the pressurization reduction mechanism 35 in FIG. 7, the negative pressure release mechanism 27 in FIG. 8, the pressurization reduction mechanism 35 in FIG. 10, and the like.

Figure 13:
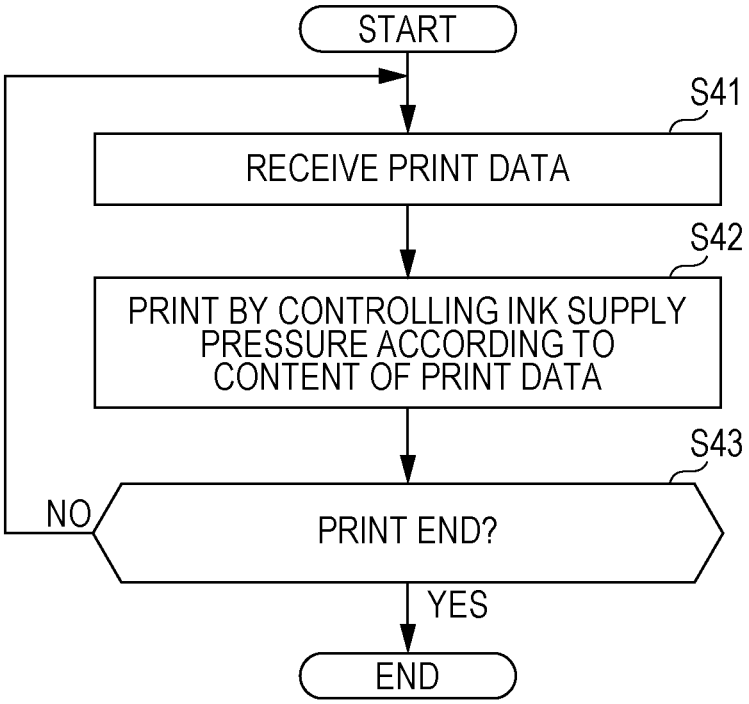
FIG. 13 is a flowchart showing control of a liquid discharge apparatus of a fourth embodiment during printing.

FIG. 13 is a flowchart showing control of the liquid discharge apparatus 10 of the fourth embodiment during printing. As shown in FIG. 13, when the receiving unit 53 receives the print data G in step S41, the controller 50 performs print by controlling the supply pressure of ink by the pressurization supply unit 30 in accordance with content of the print data G in step S42. Specifically, the controller 50 determines the discharge amount of ink from the print data G, controls the supply pressure of ink of the pressurization supply unit 30 by using, for example, the pressurization mechanism 32 in FIG. 7 in accordance with the discharge amount of ink, and drives the piezoelectric element 74. Then, in step S43, the controller 50 determines whether or not the print ends, and when determining that the print does not end, the controller 50 receives next print data G in step S41. When the controller 50 determines that the print ends in step S43, the controller 50 ends print processing.

As described above, according to the fourth embodiment, the supply pressure of ink by the pressurization supply unit 30 is controlled in accordance with the content of the print data G, so that even when ink leakage occurs due to a closing failure or the like of the valve apparatus 40, it is possible to drive the piezoelectric element 74 while suppressing crack of the vibration plate 73. Further, a situation is suppressed where the supply pressure of ink by the pressurization supply unit 30 is too much reduced in order to reduce the pressure in the liquid discharge head 26 and thereby print cannot be performed. Therefore, it is possible to increase a range of printable print data G while suppressing generation of a crack in the vibration plate 73.

It is allowed that, during printing standby (before receiving the print data G), ink is not pressurized by the pressurization supply unit 30 or the pressurization is made lower than that during printing, and the ink is pressurized immediately before printing. When there is no print data G, the supply pressure of ink by the pressurization supply unit 30 may be zero. Doing so is a preventive measure for suppressing ink leakage in the valve apparatus 40. Further, in the fourth embodiment, the drive of the piezoelectric element 74 may be restricted and the pressure in the liquid discharge head 26 may be reduced in accordance with the pressure condition in the liquid discharge head 26 as in the second embodiment while controlling the supply pressure of ink of the pressurization supply unit 30 in accordance with the content of the print data G. In other words, the supply pressure of ink is sufficiently reduced only during printing standby so that the pressure of ink in the liquid discharge head 26 does not exceed the positive side withstanding pressure of the meniscus in the nozzle N (for example, 1 KPa with respect to the atmospheric pressure) when ink leakage occurs in the valve apparatus 40. By doing so, exudation and dropping of ink from the nozzle N are prevented, and a user can complete a print operation without being abruptly interrupted in the print operation because when the print data G (or a print request) is received, it is possible to perform a print operation while securing a necessary minimum supply pressure of ink.

Modified Examples

The aspects and the embodiments illustrated above can be variously modified. Specific modified aspects are illustrated below. Two or more aspects arbitrarily selected from the examples below and the aspects described above may be appropriately combined to the extent that they do not contradict each other.

(1) In the embodiments described above, a serial head where the carriage 24 mounted with the liquid discharge head 26 is repetitively reciprocated along the X direction is illustrated. However, the invention can be applied to a line head where the liquid discharge heads 26 are arranged over the entire width of the medium 12.

(2) In the embodiments described above, the liquid discharge head 26 of a piezoelectric system using a piezoelectric element that applies a mechanical vibration to a pressure chamber is illustrated. However, it is also possible to use a liquid discharge head of a thermal system using a heating element that generates a bubble in a pressure chamber by heat.

(3) The liquid discharge apparatus 10 illustrated in the embodiment described above can be employed in various devices such as a facsimile apparatus and a copy machine in addition to a device dedicated for printing. Of course, the use of the liquid discharge apparatus 10 of the invention is not limited to printing. For example, a liquid discharge apparatus that discharges a colorant solution is used as a manufacturing apparatus that forms a color filter of a liquid crystal display apparatus, an organic EL (Electro Luminescence) display, an FED (Field Emission Display), and the like. Further, a liquid discharge apparatus that discharges a solution of conductive material is used as a manufacturing apparatus that forms wiring and electrode of a wiring board. Further, the liquid discharge apparatus 10 is also used as a chip manufacturing apparatus that discharges a solution of living organic matter as a kind of liquid.

What is claimed is:

1. A liquid discharge apparatus comprising:

a liquid discharge head that discharges a liquid by vibrating a vibration plate by a drive element and changing a pressure in an internal space filled with the liquid;

a pressurization supply unit that forcibly feeds the liquid into the liquid discharge head; and a controller that performs control of either of (A) or (B) below in accordance with detecting a pressure condition in the liquid discharge head from displacement of a flexible film constituting a part of a wall surface of a flow path of the liquid, the flexible wall being disposed within a damper chamber having an opening portion that communicates to atmospheric pressure, (A) restrict drive of the drive element in accordance with the pressure condition in the liquid discharge head, or (B) reduce a pressure of the liquid in accordance with the pressure condition in the liquid discharge head.

2. The liquid discharge apparatus according to claim 1, further comprising:

a valve apparatus that opens/closes according to pressure in the liquid discharge head in a flow path between the pressurization supply unit and the liquid discharge head, wherein the liquid is supplied to the liquid discharge head when the valve apparatus opens, and the controller performs control of either of the (A) or the (B) when liquid leakage occurs in the valve apparatus.

3. The liquid discharge apparatus according to claim 2, wherein the drive element discharges the liquid when a drive waveform is inputted, and the control of the (A) is control of restricting the drive waveform from being inputted into the drive element.

4. The liquid discharge apparatus according to claim 2, wherein the drive element discharges the liquid when a drive waveform is inputted, and the control of the (A) is control of reducing a discharge amount by the drive element.

5. The liquid discharge apparatus according to claim 2, wherein the controller performs control to restrict drive of the drive element or reduce a pressure of the liquid in accordance with the pressure condition in the liquid discharge head.

6. The liquid discharge apparatus according to claim 1, further comprising:

a receiving unit that receives print data, wherein the controller performs control of either of the (A) or the (B) after receiving the print data.

7. The liquid discharge apparatus according to claim 1, wherein the pressure condition in the liquid discharge head is detected from a residual vibration due to drive of the drive element.

8. The liquid discharge apparatus according to claim 1, wherein the pressure condition in the liquid discharge head is detected from a displacement of a flexible film constituting a part of a wall surface of a flow path of the liquid.

9. The liquid discharge apparatus according to claim 8, wherein the flexible film is a film for reducing a pressure change of the flow path of the liquid.

10. The liquid discharge apparatus according to claim 8, wherein the flexible film is a film for generating a pressure change in the flow path of the liquid.

11. The liquid discharge apparatus according to claim 1, further comprising:

a valve apparatus that opens/closes a flow path in a middle of the flow path of the liquid, wherein the valve apparatus has a valve body that opens/closes a first flow path communicating with the pressurization supply unit and a second flow path communicating with the liquid discharge head and a flexible film that moves the valve body.

12. The liquid discharge apparatus according to claim 11, wherein the pressure condition in the liquid discharge head is detected from a displacement of a flexible film of the valve apparatus.

13. The liquid discharge apparatus according to claim 1, further comprising:

a control valve that opens/closes according to pressure in the liquid discharge head, wherein when the control valve opens, the pressure in the liquid discharge head decreases.

14. The liquid discharge apparatus according to claim 1, wherein the pressurization supply unit includes a pump, a gas chamber, a liquid chamber, and a flexible film that separates the gas chamber and the liquid chamber from each other, and forcibly feeds a liquid of the liquid chamber to the liquid discharge head by pressurizing or depressurizing the gas chamber by the pump, and the controller performs the control of the (B) by controlling an atmospheric air opening valve that opens the gas chamber to atmosphere.

15. The liquid discharge apparatus according to claim 1, wherein the controller performs the control of the (B) by controlling a waste liquid valve provided in a flow path between the pressurization supply unit and the liquid discharge head.

16. The liquid discharge apparatus according to claim 15, wherein the waste liquid valve is provided in a flow path between a check valve and the liquid discharge head and the check valve is provided in a flow path between the pressurization supply unit and the liquid discharge head.

17. A liquid discharge apparatus comprising:

a liquid discharge head that discharges a liquid by vibrating a vibration plate by a drive element and changing a pressure in an internal space filled with the liquid;

a pressurization supply unit that forcibly feeds the liquid into the liquid discharge head;

a receiving unit that receives print data; and a controller that performs control of either of (C) or (D) below based upon detecting the pressure in the internal space, (C) reduce a pressure of the liquid when receiving the print data, or (D) control a supply pressure of the liquid in accordance with content of the received print data.

18. A control method of a liquid discharge apparatus, wherein the liquid discharge apparatus includes a liquid discharge head that discharges a liquid by vibrating a vibration plate by a drive element and changing a pressure in an internal space filled with the liquid, and a pressurization supply unit that forcibly feeds the liquid into the liquid discharge head, and the control method controls drive of the drive element in accordance with a change of a pressure condition in the liquid discharge head, the change of the pressure condition being detected from displacement of a flexible film constituting a part of a wall surface of a flow path of the liquid, the flexible wall being disposed within a damper chamber having an opening portion that communicates to atmospheric pressure.

19. A control method of a liquid discharge apparatus, wherein the liquid discharge apparatus includes a liquid discharge head that discharges a liquid by vibrating a vibration plate by a drive element and changing a pressure in an internal space filled with the liquid, and a pressurization supply unit that forcibly feeds the liquid into the liquid discharge head, and the control method performs control to reduce a pressure of the liquid in accordance with a pressure condition in the liquid discharge head, the pressure condition being detected from displacement of a flexible film constituting a part of a wall surface of a flow path of the liquid, the flexible wall being disposed within a damper chamber having an opening portion that communicates to atmospheric pressure.

* * * * *